US008256870B2

(12) United States Patent
Sasayama

(10) Patent No.: US 8,256,870 B2
(45) Date of Patent: Sep. 4, 2012

(54) IMAGE RECORDING APPARATUS, IMAGE PROCESSING APPARATUS AND IMAGE PROCESSING METHOD AND COMPUTER-READABLE MEDIUM

(75) Inventor: Hiroyuki Sasayama, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 372 days.

(21) Appl. No.: 12/708,222

(22) Filed: Feb. 18, 2010

(65) Prior Publication Data

US 2010/0207983 A1 Aug. 19, 2010

(30) Foreign Application Priority Data

Feb. 19, 2009 (JP) ..... 2009-037006

(51) Int. Cl.
*B41J 29/393* (2006.01)

(52) U.S. Cl. ..... 347/19; 347/14; 347/15

(58) Field of Classification Search ..... 347/5, 9, 347/14, 15, 19
See application file for complete search history.

(56) References Cited

U.S. PATENT DOCUMENTS 5,946,006 A * 8/1999 Tajika et al. ..... 347/19
7,537,305 B2 * 5/2009 Chiwata ..... 347/19
2003/0086100 A1 5/2003 Yashima et al.

FOREIGN PATENT DOCUMENTS

JP 2003-136764 A 5/2003

* cited by examiner

*Primary Examiner* — Lam S Nguyen
(74) *Attorney, Agent, or Firm* — Birch, Stewart, Kolasch & Birch, LLP

(57) ABSTRACT

An image recording apparatus includes: a recording head having a plurality of recording elements; a conveyance device which conveys at least one of the recording head and a recording medium; a recording defect information acquisition device which acquires recording defect information; a recording defect correction device which corrects an image defect caused by the recording element having a recording defect; an image reading apparatus which reads in an image of a test chart for density measurement recorded by the recording head; a recording density information acquisition device which acquires recording density information indicating recording density of the plurality of recording elements; a density correction information calculation device which calculates density correction information; a density correction device which corrects density of image data; an uncorrected recording defect information acquisition device which acquires uncorrected recording defect information; and a recording density information amendment device which amends the density correction information.

15 Claims, 19 Drawing Sheets

IMAGE RECORDING APPARATUS, IMAGE PROCESSING APPARATUS AND IMAGE PROCESSING METHOD AND COMPUTER-READABLE MEDIUM

BACKGROUND OF THE INVENTION

1. Field of the Invention

The present invention relates to an image recording apparatus, an image processing apparatus, an image processing method and a computer-readable medium, and more particularly, to an image recording apparatus, an image processing apparatus, an image processing method and a computer-readable medium which correct density non-uniformities caused by variations in the characteristics with respect to each of recording elements when an image is recorded on a recording medium (recording paper) using a recording head in which a plurality of recording elements are provided.

2. Description of the Related Art

Japanese Patent Application Publication No. 2003-136764 discloses an inkjet recording apparatus which records an image by ejecting ink onto a recording medium using a recording head in which a plurality of nozzles for ejecting ink are arranged, wherein a pattern for measuring the recording characteristics of the recording head is output, ejection failure nozzles (non-ejection nozzles) which are in a state of ejection failure (non-ejection), of the plurality of nozzles, are judged on the basis of the results of measuring the density of the pattern, the density distribution corresponding to the respective nozzles is determined, the density distribution is subjected to convolution integration using VTF (Visual Transfer Function) or PSF (Point Spread Function), whereupon the result of the portion of the density distribution corresponding to an ejection failure nozzle is compared with a predetermined reference set value, a compensation table for performing compensation using a different color to that of the ejection failure nozzle is determined for each nozzle, and the image data corresponding to an ejection failure nozzle is converted to data of a different color which is to be ejected from another head, using the compensation table.

In the technology described in Japanese Patent Application Publication No. 2003-136764, if an inexpensive scanner having low resolution is used, then the density of the portion of the ejection failure nozzle affects the measured density of the neighboring nozzles, and ejection failure correction and shading correction (density correction) are not carried out correctly. Furthermore, since ejection failures result in a readily visible image defect, then in the case of multiple-sheet printing, and the like, in particular, image processing for making ejection failures less readily visible is carried out rapidly and the output of prints containing defects ought to be reduced. However, with the technology described in Japanese Patent Application Publication No. 2003-136764, it takes time to calculate the correction values. Moreover, in a case where ejection failure correction is carried out by using ink of a different color, there are possibilities that the types of inks of different colors are restricted, for instance, only C, M and Y inks in the case of K ink, and the color tone is changed by the correction process.

One method for rapidly correcting image defects caused by the occurrence of ejection failure is a method in which an independent ejection failure correction device is provided, ejection failures are inspected for each output media, and the results of this inspection are reflected in the subsequent outputs. In other words, it is possible to correct ejection failures immediately, by additionally outputting an ejection failure determination pattern at a specific position of the output image, measuring the ejection failure determination pattern thus output, and inputting this measured ejection failure information to the ejection failure correction device.

Furthermore, a method is also known according to which a density measurement test chart is output, the output chart is measured to acquire density measurement values, density correction values are calculated on the basis of the acquired density measurement values, and the density of image data is corrected by using the calculated density correction values.

However, if this density correction is carried out in conjunction with the ejection failure correction described above, then the ejection failure correction and the density correction are duplicated, and over-correction may occur.

SUMMARY OF THE INVENTION

The present invention has been contrived in view of these circumstances, an object thereof being to provide an image recording apparatus, an image processing apparatus, an image processing method and a computer-readable medium whereby image processing can be carried out appropriately even in cases where ejection failure correction and density correction are used conjointly, without over-correction due to duplication of the ejection failure correction and the density correction.

In order to attain an object described above, one aspect of the present invention is directed to an image recording apparatus, comprising: a recording head having a plurality of recording elements; a conveyance device which conveys at least one of the recording head and a recording medium so as to cause relative movement between the recording head and the recording medium; a recording defect information acquisition device which acquires recording defect information indicating a recording element having a recording defect, of the plurality of recording elements; a recording defect correction device which corrects an image defect (image loss) caused by the recording element having a recording defect, according to the recording defect information acquired by the recording defect information acquisition device; an image reading apparatus which reads in an image of a test chart for density measurement recorded by the recording head, the image of the test chart for density measurement having been corrected by the recording defect correction device; a recording density information acquisition device which acquires recording density information indicating recording density of the plurality of recording elements, according to the image of the test chart for density measurement read in by the image reading apparatus; a density correction information calculation device which calculates density correction information according to the recording density information acquired by the recording density information acquisition device; a density correction device which corrects density of image data according to the density correction information calculated by the density correction information calculation device; an uncorrected recording defect information acquisition device which acquires uncorrected recording defect information indicating a recording element having a new recording defect which has not been corrected by the recording defect correction device when the test chart for density measurement is output; and a recording density information amendment device which amends the density correction information according to the uncorrected recording defect information acquired by the uncorrected recording defect information acquisition device.

According to this aspect of the present invention, it is performed to correct an image defect caused by a recording element having a recording defect, on the basis of recording defect information indicating a recording element having a recording defect, of a plurality of recording elements, to read in a test chart for density measurement output, to acquire recording density information, and to calculate density correction information. In that case, uncorrected recording defect information indicating a recording element having a new recording defect which has not been corrected when the test chart for density measurement is output is acquired and the density correction information is amended on the basis of this uncorrected recording defect information. Therefore, it is possible to carry out suitable image processing without the occurrence of over-correction due to duplication of ejection failure correction (non-ejection correction) and density correction, even if ejection failure correction and density correction are used conjointly.

Desirably, the plurality of recording elements of the recording head are arranged through a length corresponding to entire recordable width of the recording medium; and the conveyance device conveys at least one of the recording head and a recording medium so as to cause just one relative movement between the recording head and the recording medium.

According to this aspect of the present invention, it is possible to use a recording head which covers the entire width of the recording medium.

Desirably, the uncorrected recording defect information acquisition device acquires the uncorrected recording defect information according to a difference between the known recording defect information and the latest recording defect information.

According to this aspect of the present invention, by acquiring recording defect information at each image output, it is possible to acquire uncorrected recording defect information suitably from the difference between the previously known recording defect information and the newest recording defect information.

Desirably, the recording density information amendment device amends the density correction information according to the recording density information of a recording element separated by a prescribed amount in the recordable width direction of the recording medium from the recording element having the new recording defect.

According to this aspect of the present invention, it is possible suitably to amend the density correction information of a recording element having a recording defect and recording elements peripheral to same.

Desirably, the prescribed amount is specified in such a manner that there is no other recording element having a new recording defect between the recording element having the new recording defect and the recording element separated by the prescribed amount.

According to this aspect of the present invention, it is possible suitably to amend a recording element having a recording defect and the recording elements peripheral to same, without affecting other new recording elements having a recording defect.

Desirably, the test chart for density measurement is constituted by a plurality of different density patterns; the density correction device acquires the recording density information for each of the plurality of different density patterns; and the recording density information amendment device amends the density correction information for each of the plurality of different density patterns.

According to this aspect of the present invention, it is possible suitably to amend the density correction information respectively for each one of different density patterns.

Desirably, the plurality of recording elements are ink ejection nozzles; and the recording defect information is information indicating an ink ejection nozzle having an ejection defect.

According to this aspect of the present invention, it is possible suitably to amend the density correction information for an ink ejection nozzle having an ejection defect, even when using ink ejection nozzles as recording elements.

Desirably, the recording defect information acquisition device and the uncorrected recording defect information acquisition device acquire information indicating the ink ejection nozzle having the ejection defect by reading in, with the image reading device, an image of a test chart for ejection defect determination recorded by the recording head.

According to this mode of the present invention, it is possible suitably to acquire information indicating an ink ejection nozzle having an ejection defect.

Desirably, the recording defect correction device corrects an image defect due to the ink ejection nozzle having the ejection defect by performing substitute droplet ejection from a nozzle adjacent to the ink ejection nozzle having the ejection defect, or by increasing an ejection size of an ink droplet from a nozzle adjacent to the ink ejection nozzle having the ejection defect.

According to this aspect of the present invention, it is possible suitably to correct an image defect caused by an ink ejection nozzle having an ejection defect.

Desirably, a plurality of the recording heads are provided respectively for a plurality of colors.

According to this aspect of the present invention, it is possible to carry out image processing suitably, even if a plurality of recording heads are provided respectively for a plurality of colors.

Desirably, a reading resolution of the image reading device with respect to a direction following arrangement of the plurality of recording elements is smaller than a recording resolution of the plurality of recording elements.

According to this aspect of the present invention, it is possible to carry out image processing suitably, even when using an image reading device having a reading resolution lower than the recording resolution of the recording element.

Desirably, the density correction information calculation device calculates the density correction information according to the recording density information in such a manner that the recording density of the plurality of recording elements is uniform.

According to this aspect of the present invention, it is possible to carry out density correction suitably.

In order to attain an object described above, another aspect of the present invention is directed to an image processing apparatus, comprising: a recording defect information acquisition device which acquires recording defect information indicating a recording element having a recording defect, of a plurality of recording elements of a recording head; a recording defect correction device which corrects an image defect caused by the recording element having the recording defect, according to the recording defect information acquired by the recording defect information acquisition device; a recording density information acquisition device which acquires recording density information indicating recording density of the plurality of recording elements, according to an image of a test chart for density measurement read by an image reading device, the test chart for density measurement having been corrected by the recording defect correction device and having been recorded by the recording head; a density correction information calculation device which calculates density correction information according to the recording density information acquired by the recording density information acquisition device; a density correction device which corrects density of image data according to the density correction information calculated by the density correction information calculation device; an uncorrected recording defect information acquisition device which acquires uncorrected recording defect information indicating a recording element having a new recording defect which has not been corrected by the recording defect correction device when the test chart for density measurement is output; and a recording density information amendment device which amends the density correction information according to the uncorrected recording defect information acquired by the uncorrected recording defect information acquisition device.

According to this aspect of the present invention, it is performed to correct an image defect caused by a recording element having a recording defect, on the basis of recording defect information indicating a recording element having a recording defect, of a plurality of recording elements, to read in a test chart for density measurement output, to acquire recording density information, and to calculate density correction information. In that case, uncorrected recording defect information indicating a recording element having a new recording defect which has not been corrected when the test chart for density measurement is output is acquired and the density correction information is amended on the basis of this uncorrected recording defect information. Therefore, it is possible to carry out suitable image processing without the occurrence of over-correction due to duplication of ejection failure correction (non-ejection correction) and density correction, even if ejection failure correction and density correction are used conjointly.

In order to attain an object described above, another aspect of the present invention is directed to an image processing method, comprising: a recording defect information acquisition step of acquiring recording defect information indicating a recording element having a recording defect, of a plurality of recording elements of a recording head; a recording defect correction step of correcting an image defect caused by the recording element having the recording defect, according to the recording defect information acquired in the recording defect information acquisition step; a recording density information acquisition step of acquiring recording density information indicating recording density of the plurality of recording elements, according to an image of a test chart for density measurement read by an image reading device, the test chart for density measurement having been corrected in the recording defect correction step and having been recorded by the recording head; a density correction information calculation step of calculating density correction information according to the recording density information acquired in the recording density information acquisition step; a density correction step of correcting density of image data according to the density correction information calculated in the density correction information calculation step; an uncorrected recording defect information acquisition step of acquiring uncorrected recording defect information indicating a recording element having a new recording defect which has not been corrected in the recording defect correction step when the test chart for density measurement is output; and a recording density information amendment step of amending the density correction information according to the uncorrected recording defect information acquired in the uncorrected recording defect information acquisition step.

In order to attain an object described above, another aspect of the present invention is directed to a computer-readable medium storing instructions to cause a computer to execute at least an image processing method comprising: a recording defect information acquisition step of acquiring recording defect information indicating a recording element having a recording defect, of a plurality of recording elements of a recording head; a recording defect correction step of correcting an image defect caused by the recording element having the recording defect, according to the recording defect information acquired in the recording defect information acquisition step; a recording density information acquisition step of acquiring recording density information indicating recording density of the plurality of recording elements, according to an image of a test chart for density measurement read by an image reading device, the test chart for density measurement having been corrected in the recording defect correction step and having been recorded by the recording head; a density correction information calculation step of calculating density correction information according to the recording density information acquired in the recording density information acquisition step; a density correction step of correcting density of image data according to the density correction information calculated in the density correction information calculation step; an uncorrected recording defect information acquisition step of acquiring uncorrected recording defect information indicating a recording element having a new recording defect which has not been corrected in the recording defect correction step when the test chart for density measurement is output; and a recording density information amendment step of amending the density correction information according to the uncorrected recording defect information acquired in the uncorrected recording defect information acquisition step.

A computer-readable medium which causes a computer to implement these image processing methods is also included in the present invention.

According to the present invention, it is possible to carry out image processing suitably, without over-correction due to duplication of ejection failure correction (non-ejection correction) and density correction, even when ejection failure correction and density correction are used conjointly. Furthermore, according to the present invention, it is possible to lower the resolution of the reading device, and therefore it is possible to reduce the data volume relating to density correction and to lighten the processing load. Moreover, it is also possible to use an inexpensive reading device having a low resolution, and therefore the cost of the apparatus can be reduced.

DESCRIPTION OF THE PREFERRED EMBODIMENTS

Below, preferred embodiments of the present invention are described in detail in accordance with the accompanying drawings.

Occurrence of Over-Correction Due to Duplication of Ejection Failure Correction and Density Correction Firstly, the occurrence of over-correction due to duplication of ejection failure correction and density correction will be described.

Figure 1:
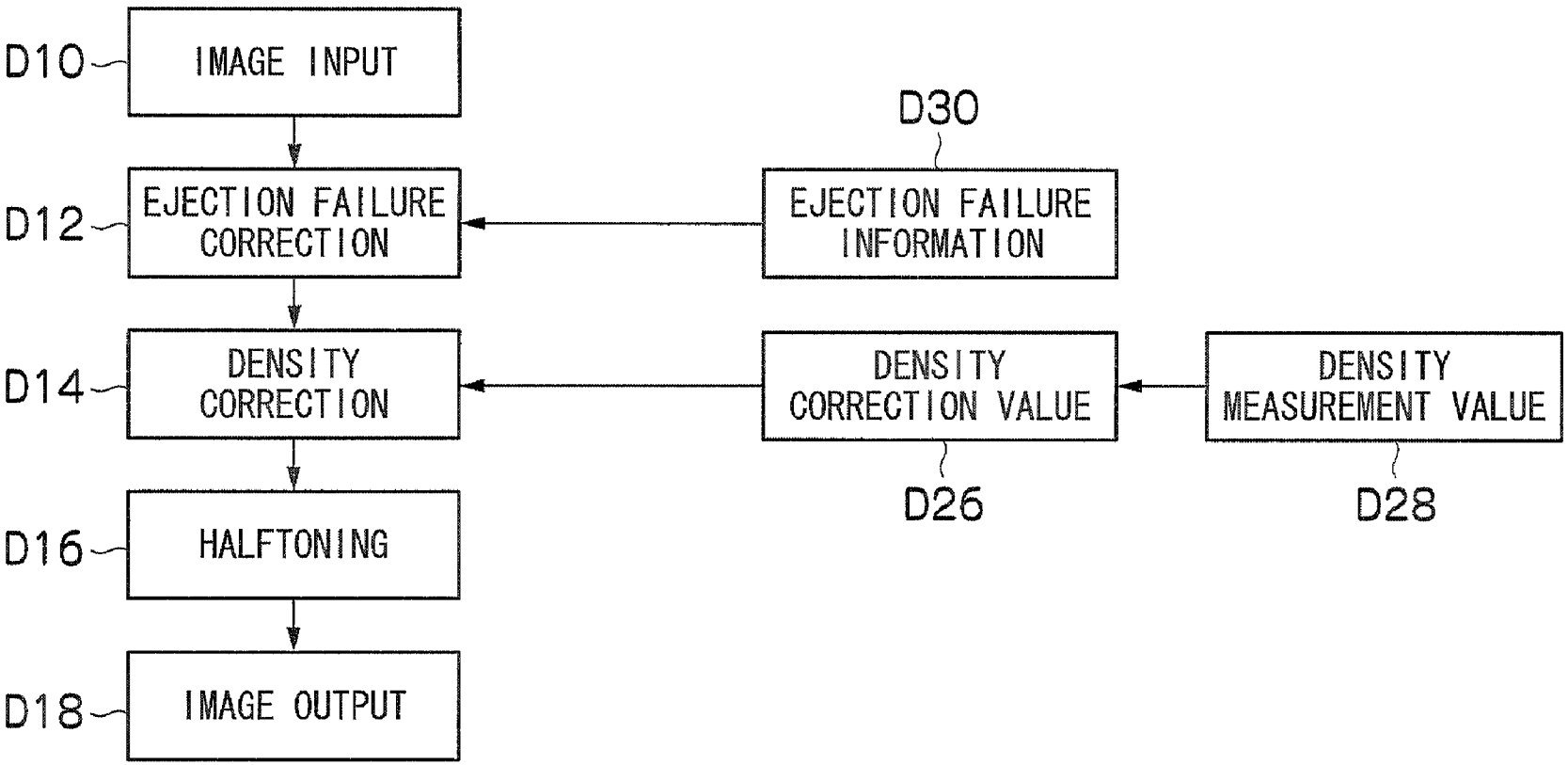
FIG. 1 is a diagram illustrating a flow of data relating to ejection failure correction and density correction according to the related art.

FIG. 1 is a diagram illustrating the flow of data relating to ejection failure correction and density correction according to the related art.

Ejection failure information (D30) relating to an ejection failure nozzle (non-ejection nozzle) is acquired by ejection failure determination (non-ejection determination). This ejection failure information (D30) is acquired from a test chart for ejection failure determination which is printed in the margin area, for example, each time an image is output. The details of the test chart for ejection failure determination are described hereinafter.

Furthermore, in the case of periodic maintenance or if there is an instruction from a user, then a density measurement value (D28) is acquired from a test chart for density measurement. The details of the test chart for density measurement are also described hereinafter. Furthermore, although the details are described hereinafter, a density correction value (D26) is calculated on the basis of the density measurement value (D28).

Ejection failure correction (D12) and density correction (D14) of the input image (D10) are carried out on the basis of the ejection failure information (D30) and the density correction value (D26). As described above, since the ejection failure information (D30) is acquired for each image output, ejection failure determined in a previous image is corrected immediately when outputting the next image, and the image is output (D18).

Here, a case of acquiring a density measurement value (D28) is explained.

Firstly, a test chart for density measurement is input as input image data (D10). Thereupon, ejection failure correction (D12) is carried out on the basis of the ejection failure information (D30). Furthermore, density correction (D14) is carried out with the density correction value (D26) in a reset (initialized) state (in other words, without performing density correction), and after carrying out halftone processing (D16), the image is output (D18).

The ejection failure correction (D12) in respect of ejection failure nozzles in the ejection failure information (D30) involves processing for changing the image data in such a manner that substitute droplet ejection (an increased number of droplet ejections) is carried out from adjacent nozzles to a nozzle suffering an ejection failure, or processing for increasing the ink droplet ejection size. Therefore, when a test chart for density measurement is output after having carried out ejection failure correction, the density of the test chart for density measurement peripheral to the ejection failure nozzle is determined as illustrated in (i) of FIG. 2B. In the example depicted, the test chart is output at 1200 dpi.

A density measurement value (D28) is acquired by carrying out density measurement on the basis of this output test chart for density measurement. (ii) of FIG. 2B illustrates a density measurement value (D28) obtained by reading in the test chart in (i) of FIG. 2B with a 500 dpi scanner. Furthermore, (iii) of FIG. 2B illustrates a density measurement value (D28) obtained by converting this density measurement value (D28) to high definition (conversion to 1200 dpi) in accordance with the resolution of the image data.

(iv) of FIG. 2B illustrates a density correction value calculated on the basis of the density measurement value (D28) which has been converted to high definition. The density correction involves processing for adjusting the ink droplet ejection size ejected from nozzles having low density measurement value, in such a manner that the density becomes greater, and adjusting the ink droplet ejection size ejected from nozzles having high density measurement value, in such a manner that the density becomes lower.

Furthermore, (v) of FIG. 2B is a diagram illustrating the nozzle output when density correction has been carried out using the density correction value (D26) indicated in (iv) of FIG. 2B. Moreover, (vi) of FIG. 2B is a diagram illustrating the density of the actual output image (D18) when ejection failure correction (D12) has been carried out in addition to the density correction (D14) based on the density correction value indicated by (iv) of FIG. 2B.

As stated above, the ejection failure information (D30) is acquired for each image output. Consequently, even if this test chart for density measurement has been output, a test chart for ejection failure determination is output to the margin area thereof and ejection failure information (D30) is acquired. Subsequent ejection failure correction (D12) of images is carried out on the basis of the acquired ejection failure information (D30).

In this way, when a test chart for density measurement is output, ejection failure correction (D12) is carried out in respect of known ejection failures which are stored in the ejection failure information (D30), and ejection failures have virtually no effect on the density measurement. Here, the ejection failure nozzle illustrated in FIG. 2B is included previously in the ejection failure information (D30), and ejection failure correction (D12) is carried out. Consequently, in subsequent output data, there are no problems even if ejection failure correction (D12) and density correction (D14) are carried out respectively.

Next, a case where a new ejection failure nozzle has occurred when the density measurement value (D28) is acquired, will be described.

Firstly, a test chart for density measurement is input as input image data (D10). Thereupon, ejection failure correction (D12) is carried out on the basis of the ejection failure information (D30). Since the new ejection failure nozzle has not been determined at this time, then information relating to the new ejection failure nozzle has not yet been stored in the ejection failure information (D30).

Figure 2A:
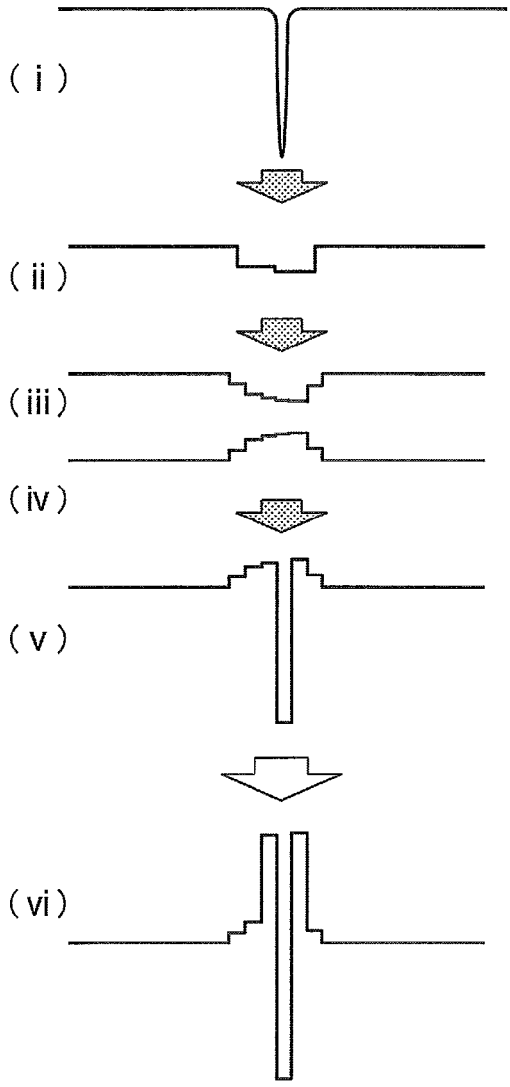
FIGS. 2A and 2B are diagrams for describing over-correction in a case where ejection failure correction and density correction are carried out conjointly.
Figure 2B:
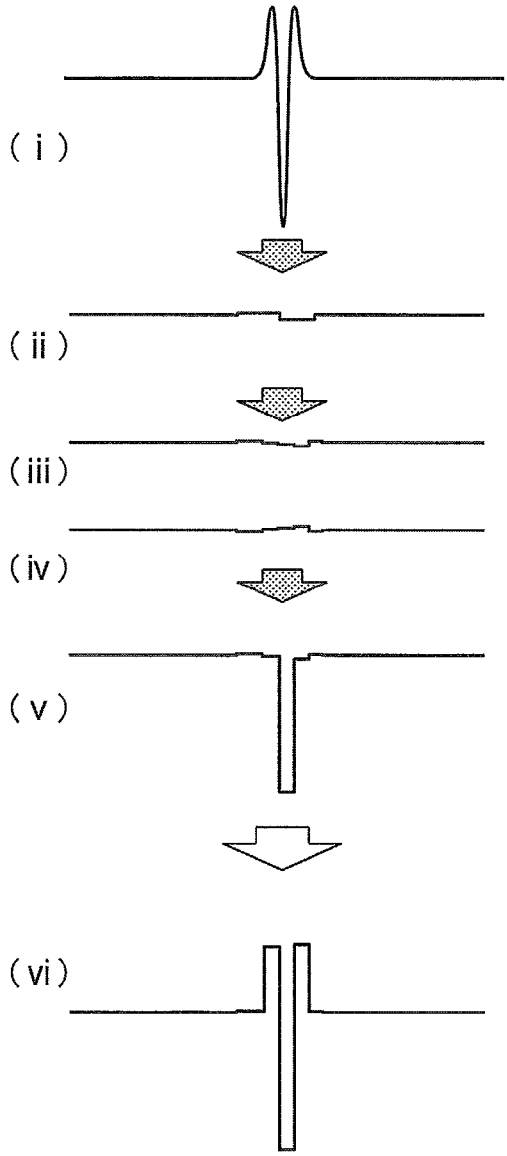

Therefore, the density peripheral to the ejection failure nozzle in the test chart for density measurement output here will have a distribution such as that illustrated in (i) of FIG. 2A. Since ejection failure correction is not carried out in respect of the new ejection failure nozzle in this way, then the ejection failure is measured as a white stripe-shaped density loss.

(ii) of FIG. 2A illustrates the density measurement value (D28) obtained by reading out the test chart in (i) of FIG. 2A which has a white stripe-shaped density defect, with a 500 dpi scanner, and (iii) of FIG. 2A illustrates the density measurement value (D28) obtained by converting this density measurement value (D28) to high definition (conversion to 1200 dpi) in accordance with the resolution of the image data. If the resolution of the scanner is lower than the nozzle resolution in this way, then the white stripe-shaped density loss is determined as a density loss having a prescribed width.

(iv) of FIG. 2A illustrates a density correction value (D26) calculated on the basis of the density measurement value (D28) which has been converted to high definition. As stated above, the density correction involves processing for adjusting the ink droplet ejection size ejected from nozzles having low density measurement value, in such a manner that the density becomes greater, and adjusting the ink droplet ejection size ejected from nozzles having high density measurement value, in such a manner that the density becomes lower. Consequently, a density correction value (D26) which makes the density higher is set in respect of the density loss having a prescribed width.

Furthermore, (v) of FIG. 2A is a diagram illustrating the nozzle output when density correction (D14) has been carried out using the density correction value (D26) indicated in (iv) of FIG. 2A. As illustrated in (v) of FIG. 2A, the white stripe-shaped density loss caused by the new ejection failure nozzle is taken as a density loss having a prescribed width and is corrected by density correction (D14).

Moreover, ejection failure information (D30) is acquired by means of a test chart for ejection failure determination which is output at the same time as outputting the test chart for density measurement. In other words, the new ejection failure nozzle is first added to the ejection failure information (D30) at this stage.

Consequently, in the subsequent image output, density correction (D14) is carried out on the basis of the density correction value (D26) illustrated in (iv) of FIG. 2A, and furthermore ejection failure correction (D12) is also carried out on the basis of the ejection failure information (D30), and therefore ejection failure correction is also carried out despite the fact that density correction has been performed on the basis of the density loss having a prescribed width relating to the new ejection failure, as illustrated in (vi) of FIG. 2A.

As described above, the present inventor has discovered that if a new ejection failure nozzle has occurred when a test chart for density measurement is output, then ejection failure correction and density correction are duplicated in the peripheral region of the ejection failure nozzle and hence there is a possibility that over-correction occurs.

Process for Calculating Density Correction Value

Figure 3:
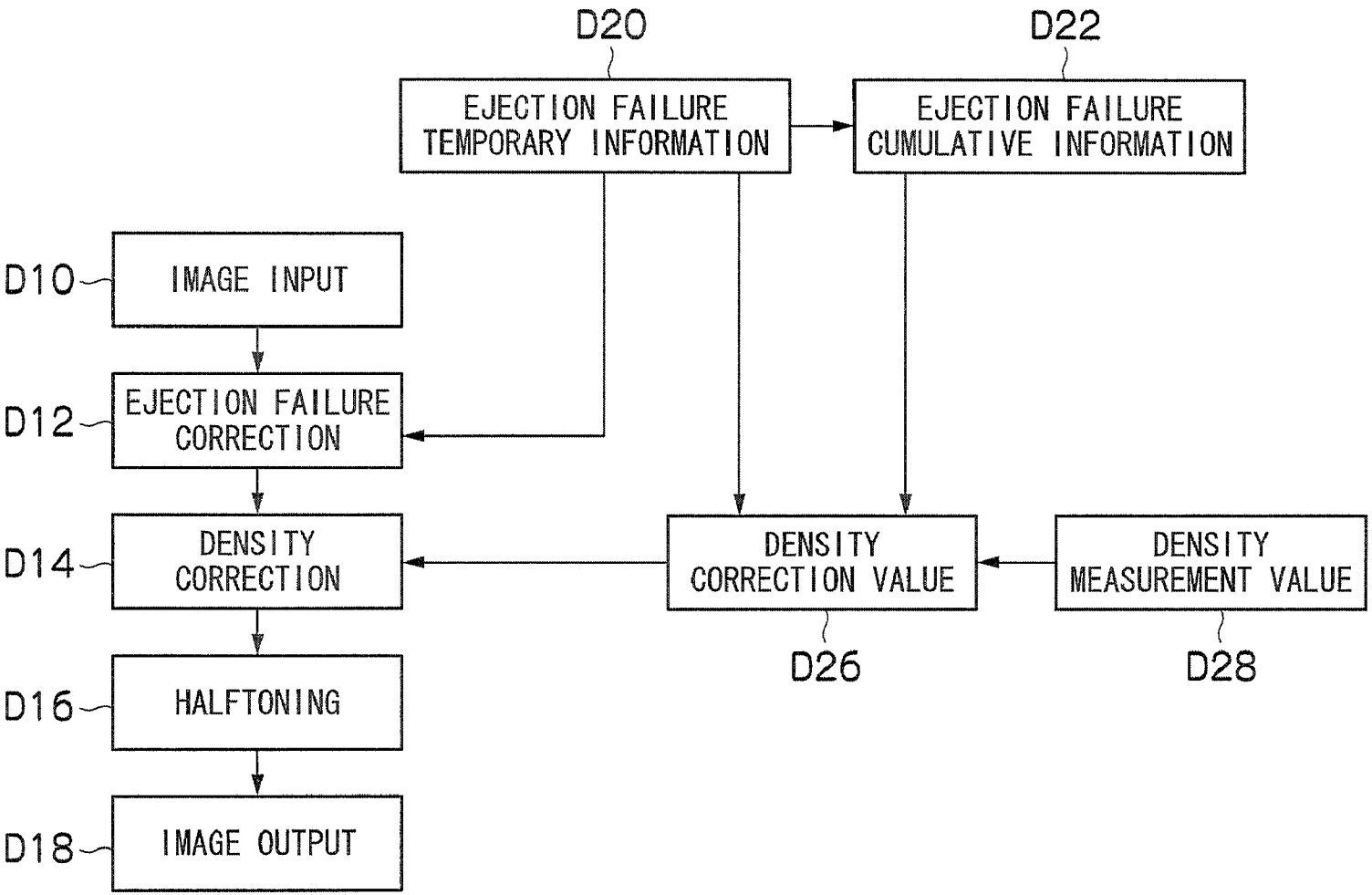
FIG. 3 is a diagram illustrating a flow of data relating to ejection failure correction and density correction according to an embodiment of the present invention.

FIG. 3 is a diagram illustrating a flow of data relating to ejection failure correction and density correction according to an embodiment of the present invention. In the present embodiment, in order to confirm the ejection failure state when outputting a test chart for density measurement, ejection failure temporary information (D20) and ejection failure cumulative information (D22) are provided as information relating to ejection failure nozzles.

Similarly to the ejection failure information (D30) in FIGS. 2A and 2B, the ejection failure temporary information (D20) relating to the ejection failure nozzle is acquired by ejection failure determination. This ejection failure temporary information (D20) is acquired each time an image is output, and the ejection failure temporary information (D20) acquired up to and including the preceding image output is accumulated in the ejection failure cumulative information (D22). Consequently, by comparing the ejection failure temporary information (D20) and the ejection failure cumulative information (D22), it is possible to acquire information about a new ejection failure nozzle.

Figure 4:
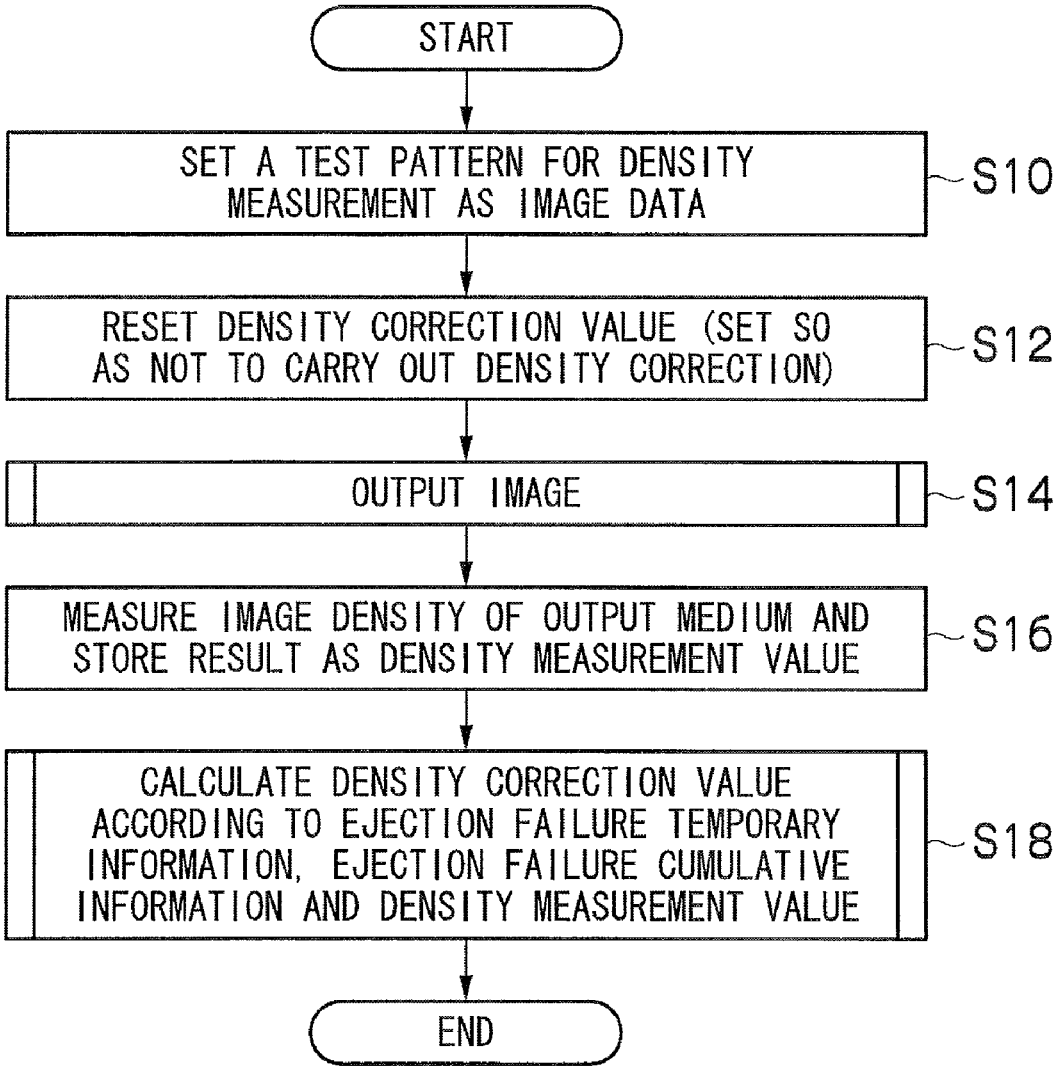
FIG. 4 is a flowchart showing the entire process of calculating a density correction value.

The process for calculating a density correction value according to the present embodiment will now be described. FIG. 4 is a flowchart showing the entire process of calculating the density correction value.

Firstly, the test chart for density measurement is set as image data (step S10 in FIG. 4).

Next, the ejection failure temporary information (D20) and ejection failure cumulative information (D22) are acquired (step S12). Moreover, in order to output a test chart for density measurement without carrying out density correction, the density correction value (D26) is reset (step S12).

A test chart for density measurement is output on the basis of the sets of acquired data (step S14). As illustrated in FIG. 3, in this image output, ejection failure correction (D12) is carried out on the basis of the ejection failure temporary information (D20) and density correction is carried out on the basis of the reset density correction value (D26). Moreover, halftone processing (D16) is carried out and an image is output (D18) onto media. Rather than resetting the density correction value (D26) at step S12, it is also possible to output the test chart for density measurement, C2, without carrying out density correction in D14.

The densities of the respective nozzles are measured from the test chart for density measurement thus output, and a density measurement value (D28) in the nozzle row direction is acquired for each density patch, for each color (step S16).

Furthermore, ejection failure temporary information (D20) relating to ejection failure nozzles is acquired by ejection failure determination. This ejection failure temporary information (D20) is acquired from a test chart for ejection failure determination which is printed in the margin area of the test chart for density measurement.

A density correction value (D26) is calculated on the basis of the ejection failure temporary information (D20), the ejection failure cumulative information (D22), and the density measurement value (D28) acquired in this way (step S18).

Figure 5:
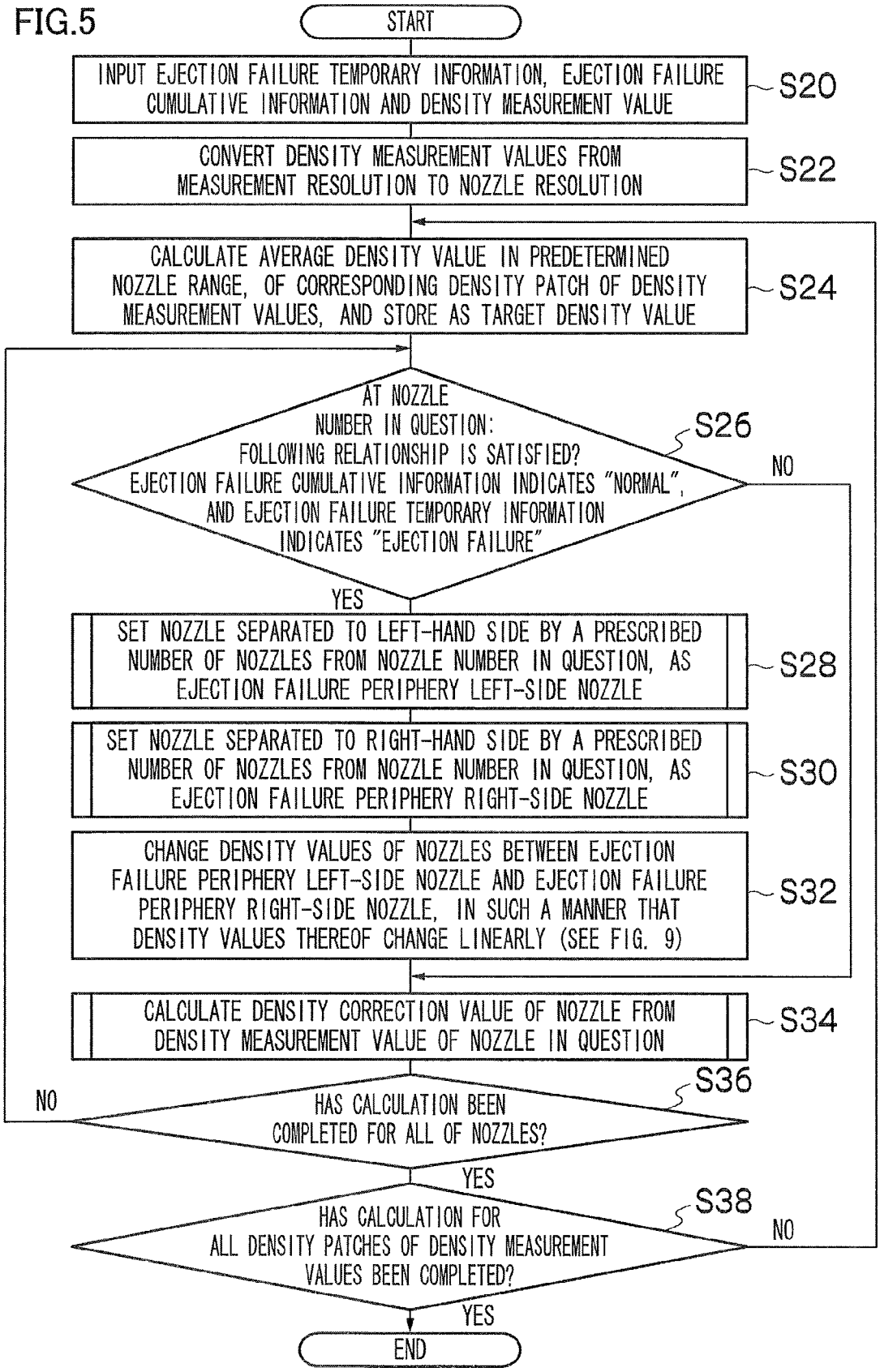
FIG. 5 is a flowchart showing a process of calculating a density correction value.

Here, the details of the calculation of the density correction value (D26) in step S18 will be described with reference to the flowchart in FIG. 5.

Firstly, the ejection failure temporary information (D20), the ejection failure cumulative information (D22) and the density measurement value (D28) are acquired (step S20).

Next, the density measurement value (D28) is converted from the measurement resolution to the nozzle resolution (step S22). As illustrated in step S200 in FIG. 6, the density measurement value (D28) for each density measurement position acquired at step S20 is converted to a density measurement value for each nozzle position, following a resolution conversion curve which represents the correspondence between the scanner pixel positions (density measurement positions) and the nozzle positions.

Furthermore, an average density within a predetermined nozzle range is calculated for the corresponding density patch of the density measurement value (D28), and this average density is stored as a target density value (step S24).

Here, it is judged, for each nozzle in sequence from the end nozzle, whether the ejection failure cumulative information (D22) is normal and whether or not the ejection failure temporary information (D20) has suffered an ejection failure (in other words, whether or not the nozzle in question is a new ejection failure nozzle), on the basis of the acquired ejection failure temporary information (D20) and ejection failure cumulative information (D22) (step S26).

Figure 6:
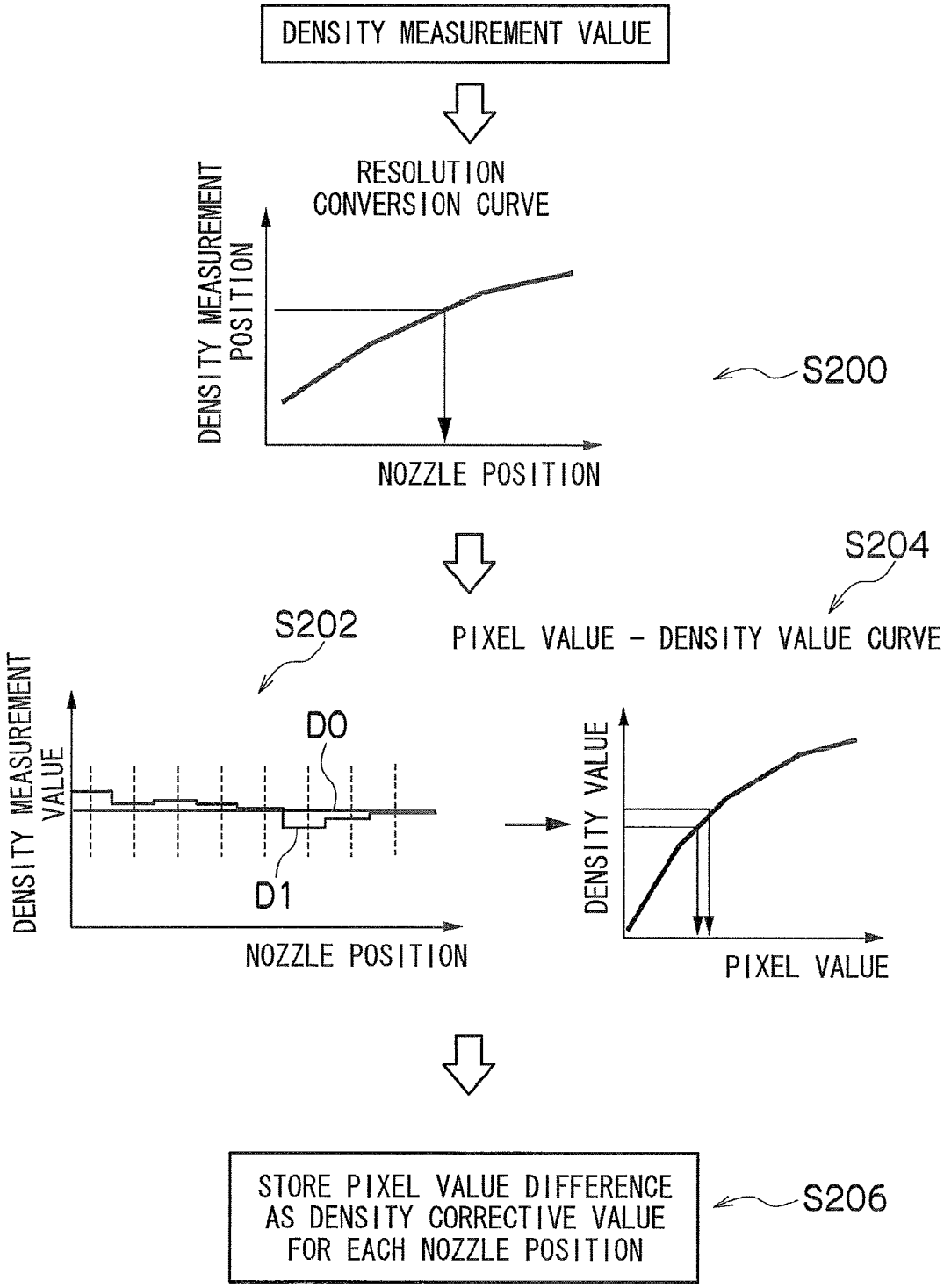
FIG. 6 is a diagram for describing the calculation of a density correction value based on density measurement values.

If the nozzle is not a new ejection failure nozzle, then the density correction value (D26) for that nozzle is calculated from the density measurement value (D28) of the nozzle (step S34). In calculating the density correction value (D26), firstly, as illustrated in FIG. 6, the differential between the density data D1 for each nozzle position obtained at step S200 and the target density value D0 calculated previously is calculated (step S202). Next, the differential in the density value calculated at step S202 is converted to a differential in pixel value, in accordance with a pixel value to density value curve which represents the correspondence between the pixel value and the density value (step S204). This differential in the pixel value is stored as a density correction value (D26) for each respective nozzle position (step S206).

Figure 7:
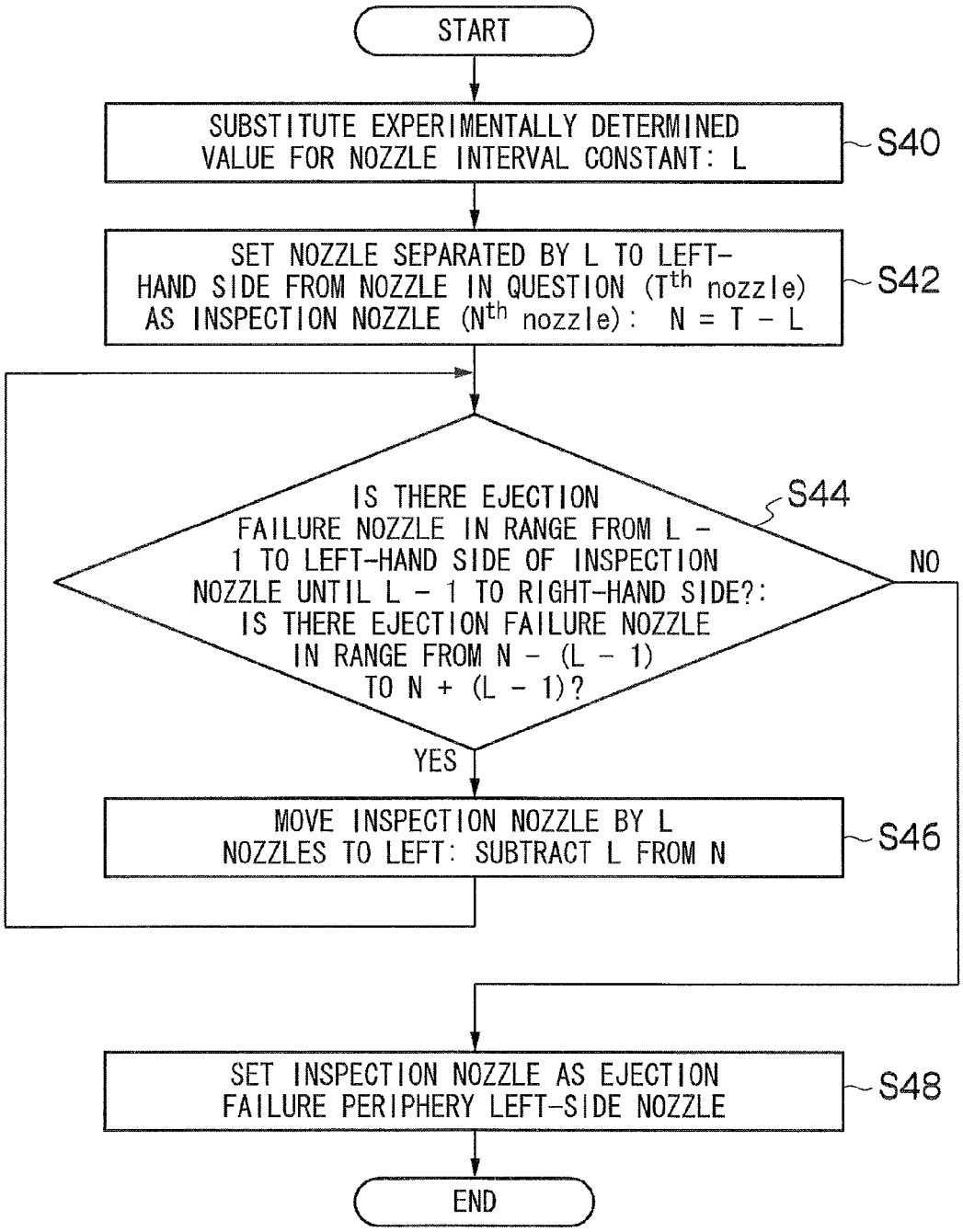
FIG. 7 is a flowchart showing a process of calculating an ejection failure periphery left-side nozzle.

On the other hand, at step S26, if it is judged that the nozzle is a new ejection failure nozzle, then a nozzle separated to the left-hand side by a prescribed amount from the nozzle is set as an ejection failure periphery left-side nozzle (step S28). The details of step S28 are described here with reference to the flowchart in FIG. 7.

Firstly, a value determined experimentally is substituted for the nozzle interval constant L (step S40). Here, L is taken to be L=4, but L is not limited to this value and may be set appropriately. A nozzle separated by L from the nozzle in question (taken to be the $T^{th}$ nozzle from the left) in the left side is taken as the inspection nozzle ($N^{th}$ nozzle) (step S42). In other words, N=T−L.

Thereupon, it is judged whether or not there is an ejection failure nozzle in the range up to L−1 to the left-hand side and L−1 to the right-hand side from the inspection nozzle, on the basis of the ejection failure temporary information (D20) and the ejection failure cumulative information (D22), in other words, whether or not there is an ejection failure nozzle in the range of N−(L−1) to N+(L−1) (step S44).

If there is an ejection failure nozzle in the range of N−(L−1) to N+(L−1), then the inspection nozzle is changed by L towards the left, by subtracting L from N (step S46), and it is again judged whether or not there is an ejection failure nozzle in the range of N−(L−1) to N+(L−1) (step S44).

If there is no ejection failure nozzle in the range of N−(L−1) to N+(L−1), then the inspection nozzle is set as an ejection failure periphery left-side nozzle (step S48). In this way, the ejection failure periphery left-side nozzle is determined.

If there is still an ejection failure nozzle in the range of N−(L−1) to N+(L−1), even after changing the inspection nozzle up to the furthest left-hand nozzle, then it is desirable that processing should be suspended and an error returned.

Figure 8:
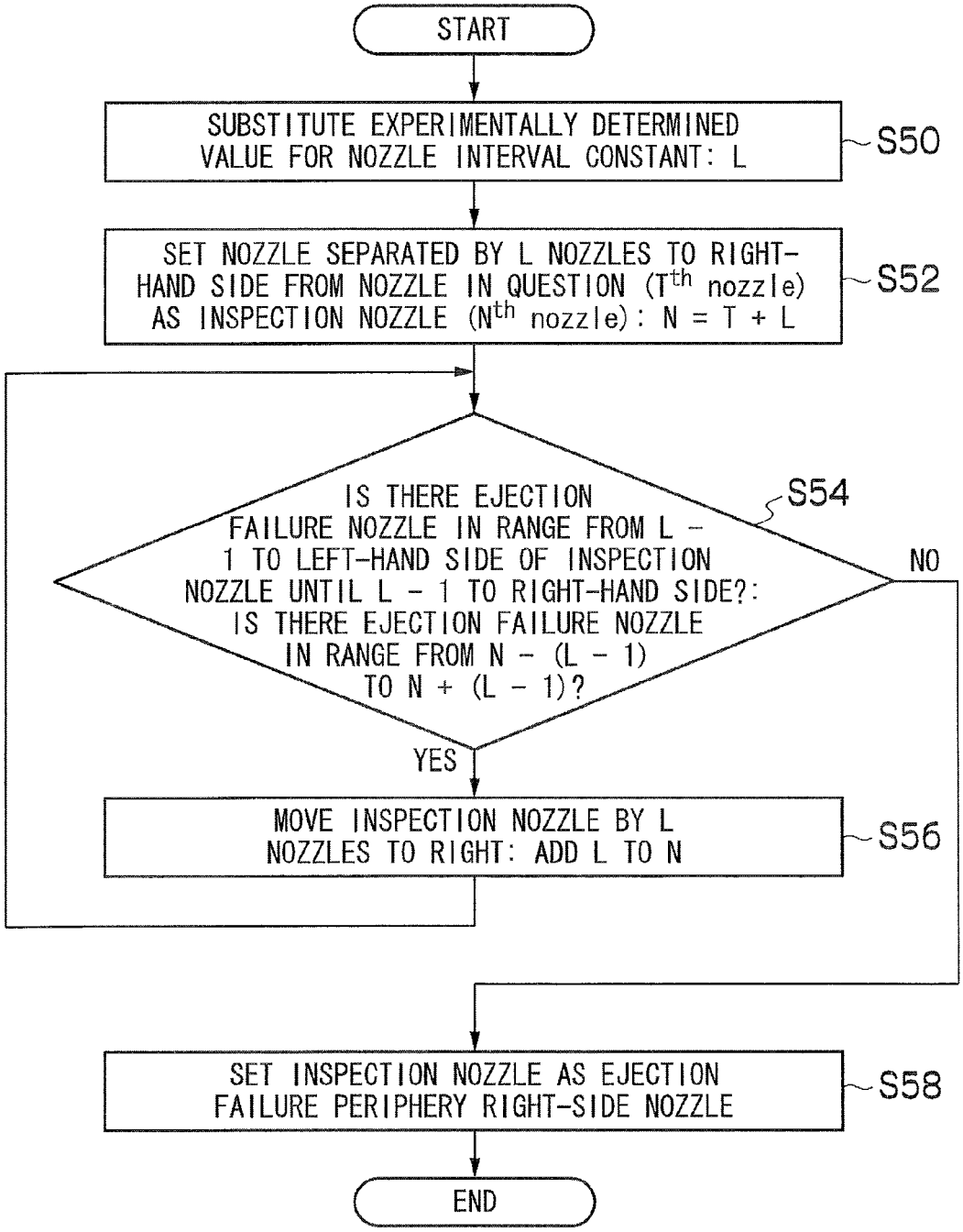
FIG. 8 is a flowchart showing a process of calculating an ejection failure periphery right-side nozzle.

Returning to FIG. 5, a nozzle separated to the right-hand side by a required number from the nozzle number in question is set as an ejection failure periphery right-side nozzle (step S30). The details of step S30 are described here with reference to the flowchart in FIG. 8.

Similarly to the case of the ejection failure periphery left-side nozzle, a value determined experimentally is substituted for the nozzle interval constant L (step S50). Here, L is taken to be L=4, but L is not limited to this value and may be set appropriately. Desirably, this constant is the same as the L value used for the ejection failure periphery left-side nozzle.

Moreover, a nozzle separated to the right-hand side by L from the nozzle in question (which is taken to be the $T^{th}$ nozzle from the left) is set as the inspection nozzle ($N^{th}$ nozzle) (step S52). In other words, N=T+L.

Thereupon, it is judged whether or not there is an ejection failure nozzle in the range up to L−1 to the left-hand side and L−1 to the right-hand side from the inspection nozzle, on the basis of the ejection failure temporary information (D20) and the ejection failure cumulative information (D22), in other words, whether or not there is an ejection failure nozzle in the range of N−(L−1) to N+(L−1) (step S54).

If there is an ejection failure nozzle in the range of N−(L−1) to N+(L−1), then the inspection nozzle is changed by L towards the right, by adding L to N (step S56), and it is again judged whether or not there is an ejection failure nozzle in the range of N−(L−1) to N+(L−1) (step S54).

If there is no ejection failure nozzle in the range of N−(L−1) to N+(L−1), then the inspection nozzle is set as an ejection failure periphery right-side nozzle (step S48). In this way, the ejection failure periphery right-side nozzle is determined.

Similarly to the case of the ejection failure periphery left-side nozzle, if there is still an ejection failure nozzle in the range of N−(L−1) to N+(L−1), even after changing the inspection nozzle up to the furthest right-hand nozzle, then it is desirable that processing should be suspended on account of the occurrence of an error.

Returning again to FIG. 5, the density measurement values (D28) of the nozzles between the ejection failure periphery left-side nozzle and the ejection failure periphery right-side nozzle are changed in such a manner that there is a linear density change between these nozzles (step S32).

Figure 9:
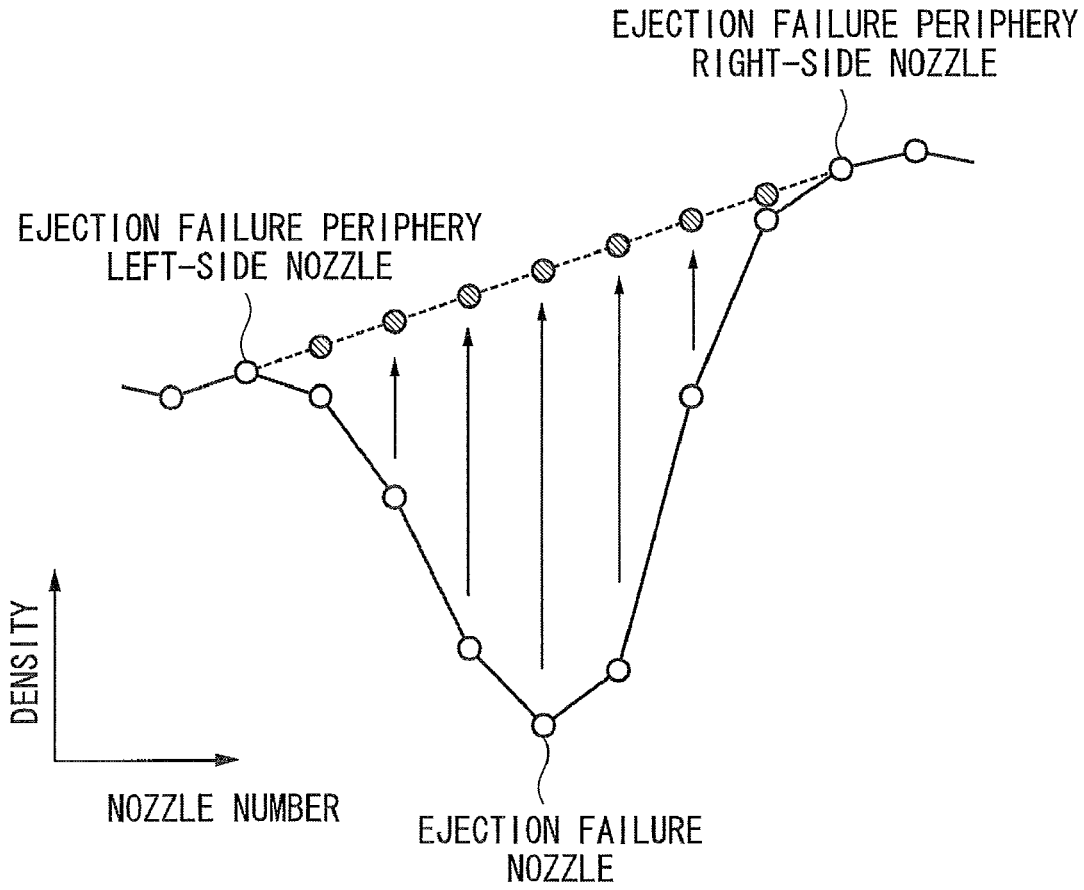
FIG. 9 is a diagram for describing processing for changing the density measurement values between an ejection failure periphery left-side nozzle and an ejection failure periphery right-side nozzle.

FIG. 9 is a diagram for describing the processing in step S32.

As indicated by the white circles in FIG. 9, the density is measured to be lower in the area of the ejection failure nozzle due to the ejection failure. Furthermore, although there is not necessarily an actual decline in density about the periphery of the ejection failure nozzle, as a result of the scanner resolution, the measured density is lower due to the effects of the ejection failure. In step S32, the density measurement values (D28) from the ejection failure periphery left-side nozzle until the ejection failure periphery right-side nozzle are altered as indicated by the black circles, so as to achieve a linear density change in the portion where the density has fallen. In other words, the incorrect measurement of density caused by the ejection failure nozzle is corrected.

The density correction value (D26) for the nozzle in question is calculated on the basis of the density measurement values (D28) which have been changed in this way (step S34). This calculation process is similar to that described with reference to FIG. 6.

Returning to FIG. 5, it is judged whether or not this calculation process has been carried out in respect of the all of the nozzles (step S36), and if there are nozzles for which the calculation has not been completed, then the procedure returns to step S26, the nozzle in question is moved to the right, and then a similar process is repeated. If calculation has been completed for all of the nozzles, then it is judged whether or not calculation has been completed in respect of the all of the density patches (step S38), and if it has not been completed, then the procedure returns to step S24 and a similar process is repeated in respect of all of the density patches.

This processing is carried out in respect of the nozzles of all colors.

The results of correction in respect of a new ejection failure nozzle when the processing described above has been carried out will now be explained.

Figure 10:
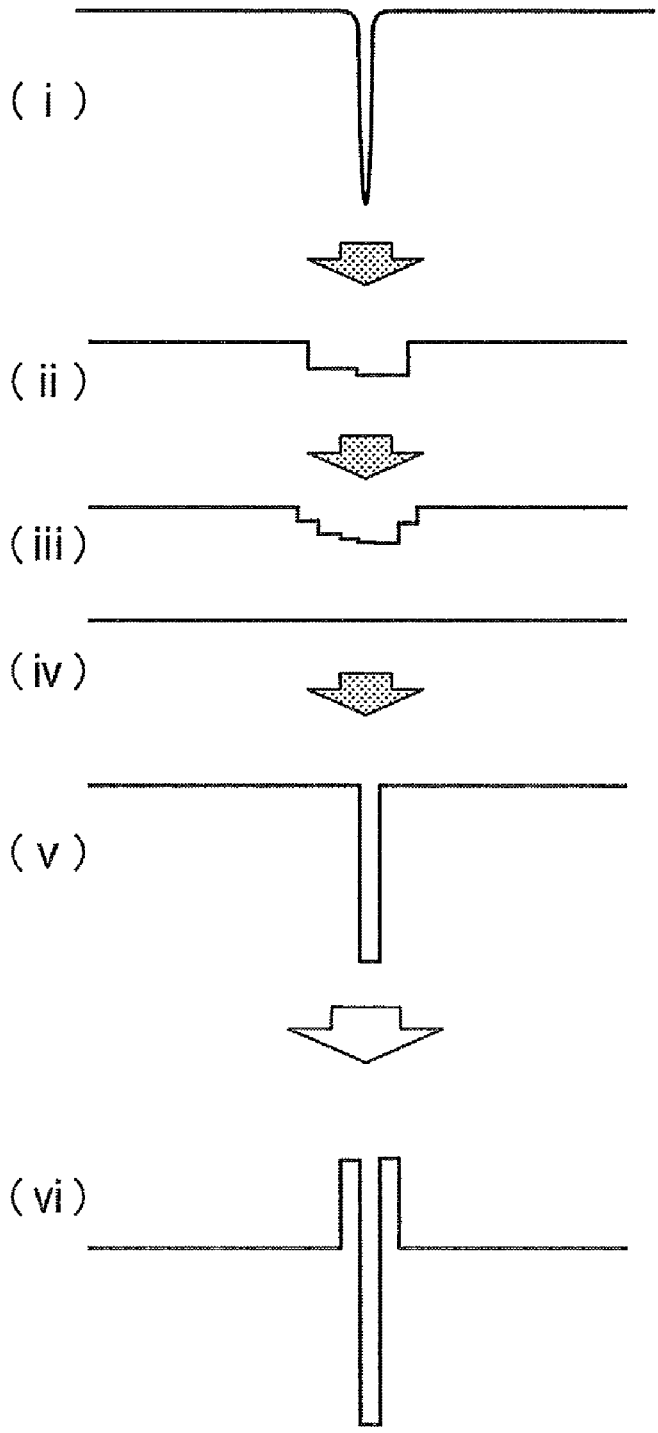
FIG. 10 is a diagram for describing correction in a case where ejection failure correction and density correction are carried out conjointly, according to an embodiment of the present invention.

(i) of FIG. 10 illustrates the density of the periphery of an ejection failure in a test chart for density measurement, in a case where there is a new and previously undetected ejection failure nozzle. Similarly to (i) of FIG. 2A, since ejection failure correction is not carried out in respect of the new ejection failure nozzle, then the ejection failure is measured as a white stripe-shaped density loss.

(ii) of FIG. 10 illustrates the density measurement value (D28) obtained by reading out the test chart in (i) of FIG. 10 which has a white stripe-shaped density defect, with a 500 dpi scanner, and (iii) of FIG. 10 illustrates the density measurement value (D28) obtained by converting this density measurement value (D28) to high definition (conversion to 1200 dpi) in accordance with the resolution of the image data. In this way, density loss caused by a new ejection failure nozzle is determined as a density loss having a prescribed width.

(iv) of FIG. 10 illustrates a density correction value (D26) calculated in respect of the density measurement value (D28) illustrated in (iii) of FIG. 10 on the basis of the ejection failure temporary information (D20) and the ejection failure cumulative information (D22). In this way, the density correction value (D26) is virtually unaffected by the new ejection failure.

Furthermore, (v) of FIG. 10 is a diagram illustrating the nozzle output when density correction has been carried out using the density correction value (D26) indicated in (iv) of FIG. 10. Moreover, (vi) of FIG. 10 is a diagram illustrating the density of the actual output image (D18) when ejection failure correction (D12) has been carried out in addition to the density correction (D14) based on the density correction value indicated by (iv) of FIG. 10. As illustrated in FIG. 10, it can be seen that over-correction based on the density correction (D14) and the ejection failure correction (D12) is not carried out in respect of the newly occurring ejection failure nozzle.

Even if a new ejection failure nozzle has occurred in this way, it is possible to carry out suitable density correction in respect of the ejection failure nozzle and the nozzles peripheral to same.

Composition of Inkjet Recording Device

Next, an inkjet recording device is described as a concrete example of the application of an image recording apparatus which carries out the ejection failure correction and density correction described above.

Figure 11:
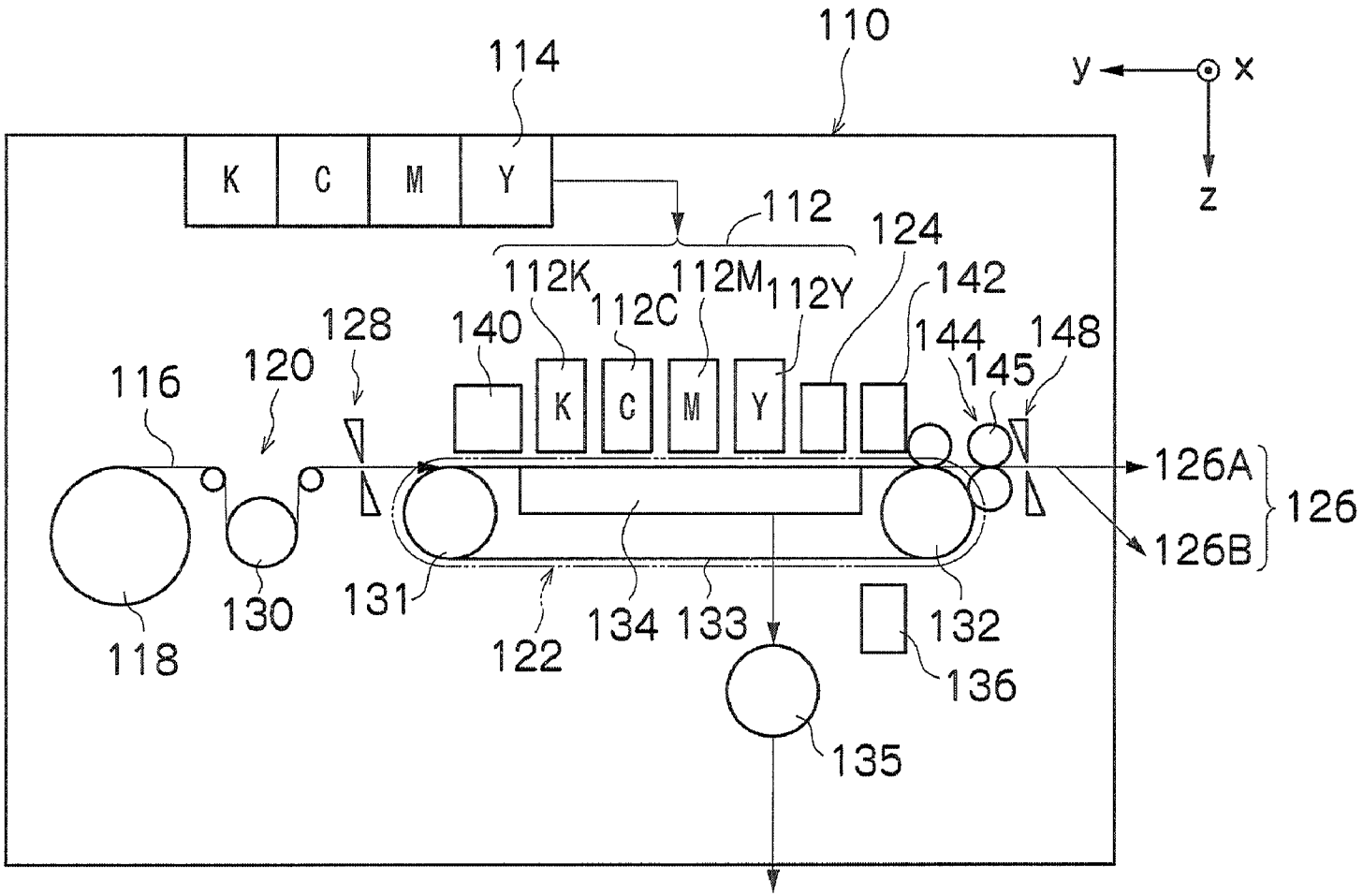
FIG. 11 is a general schematic drawing of an inkjet recording device employing an image processing apparatus relating to one embodiment of the present invention.

FIG. 11 is a general configuration diagram of an image forming device according to one embodiment of the present invention. As illustrated in FIG. 11, the inkjet recording apparatus 110 according to the present embodiment comprises: a recording head (printing unit) 112 having a plurality of inkjet recording heads (hereafter, also simply called "heads") 112K, 112C, 112M, and 112Y provided for the respective ink colors (i.e. black, cyan, magenta and yellow); an ink storing and loading unit 114 for storing inks of K, C, M and Y to be supplied to the printing heads 112K, 112C, 112M, and 112Y; a paper supply unit 118 for supplying recording paper (recording medium) 116; a decurling unit 120 removing curl in the recording paper 116; a belt conveyance unit 122 disposed facing the nozzle face (ink-droplet ejection face) of the recording head 112, for conveying the recording paper 116 while keeping the recording paper 116 flat; a print determination unit 124 for reading the recorded result produced by the recording head 112; and a paper output unit 126 for outputting image-printed paper (printed matter) to the exterior.

The ink storing and loading unit 114 comprises ink tanks for storing inks of colors corresponding to the heads 112K, 112C, 112M and 112Y, and the ink tanks are respectively connected to the heads 112K, 112C, 112M and 112Y via prescribed channels. The ink storing and loading unit 114 also comprises a warning device (for example, a display device or an alarm sound generator) for warning when the remaining amount of any ink is low, and has a mechanism for preventing loading errors between different colors.

In FIG. 11, a magazine for rolled paper (continuous paper) is illustrated as an example of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording media can be used, it is desirable that an information recording medium such as a bar code and a wireless tag containing information about the type of medium is attached to the magazine, and by reading the information contained in the information recording medium with a predetermined reading device, the type of medium to be used is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is desirably controlled so that the recording paper 116 has a curl in which the surface on which the print is to be made is slightly round outward.

In the case of a configuration in which roll paper is used, a cutter (first cutter) 128 is provided and the roll paper is cut to a desired size by the cutter 128. When cut paper is used, the cutter 128 is not required.

The decurled and cut recording paper 116 is delivered to the suction belt conveyance unit 122, The suction belt conveyance unit 122 has a configuration in which an endless belt 133 is set around rollers 131 and 132 so that the portion of the endless belt 133 facing at least the nozzle face of the recording head 112 and the sensor face of the print determination unit 124 forms a plane (flat face).

The belt 133 has a width that is greater than the width of the recording paper 116, and a plurality of suction apertures (not illustrated) are formed on the belt surface. A suction chamber 134 is disposed in a position facing the sensor surface of the print determination unit 124 and the nozzle surface of the recording head 112 on the interior side of the belt 133, which is set around the rollers 131 and 132, as illustrated in FIG. 11. The suction chamber 134 provides suction with a fan 135 to generate a negative pressure, and the recording paper 116 on the belt 133 is held by suction. Instead of this suction system, an electrostatic adsorption system may be used The belt 133 is driven in the clockwise direction in FIG. 11 by the motive force of a motor (reference numeral 188 in FIG. 16) being transmitted to at least one of the rollers 131 and 132, which the belt 133 is set around, and the recording paper 116 held on the belt 133 is conveyed from left to right in FIG. 11.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not illustrated, examples thereof include a configuration in which the belt 133 is nipped with cleaning rollers such as a brush roller and a water absorbent roller, an air blow configuration in which clean air is blown onto the belt 133, and a combination of these. In the case of the configuration in which the belt 133 is nipped with the cleaning rollers, it is desirable to make the line velocity of the cleaning rollers different from that of the belt 133 to improve the cleaning effect.

A roller nip conveyance mechanism, in place of the belt conveyance unit 122, can be employed. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is desirable.

A heating fan 140 is disposed on the upstream side of the recording head 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 12:
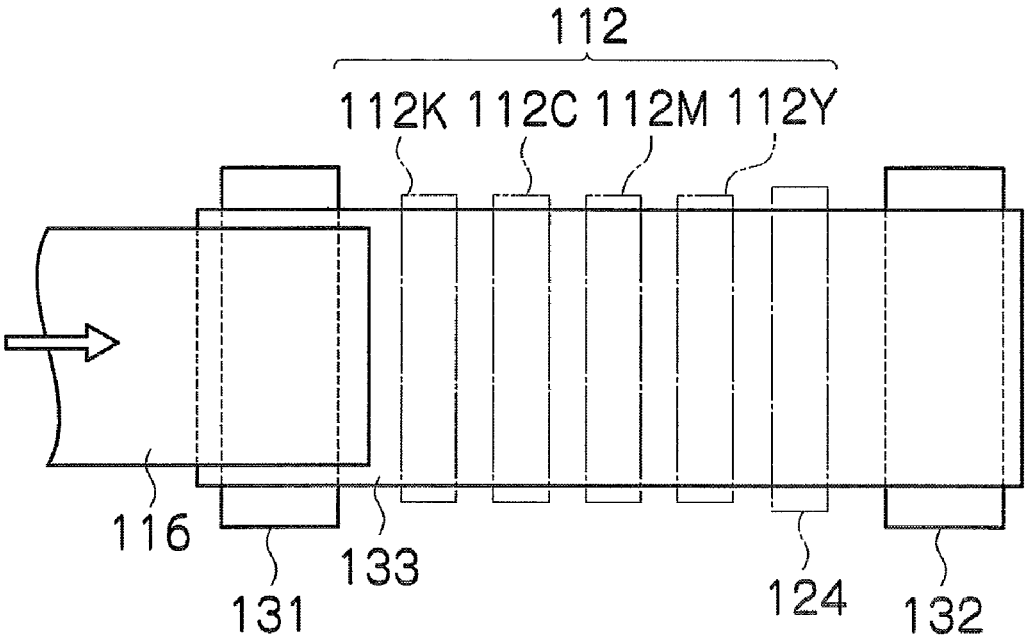
FIG. 12 is a plan view of the principal part of the peripheral area of a recording head in the inkjet recording apparatus illustrated in FIG. 11.

The recording head 112 is a so-called "full line head" in which a line head having a length corresponding to the maximum paper width of the recording paper 116 is fixed extending in a direction (main scanning direction) that is perpendicular to the paper conveyance direction (sub scanning direction). Each of the printing heads 112K, 112C, 112M, and 112Y constituting the recording head 112 is constituted by a line head, in which a plurality of ink ejection ports (nozzles) are arranged along a length (entire width of the recordable area) that exceeds at least one side of the maximum-size recording paper 116 intended for use in the inkjet recording apparatus 110 (see FIG. 12).

The printing heads 112K, 112C, 112M, and 112Y are arranged in the color order of black (K), cyan (C), magenta (M), and yellow (Y) from the upstream side, along the feed direction of the recording paper 116, and are fixed so as to extend in the direction which is substantially perpendicular to the conveyance direction of the recording paper 116.

A color image can be formed on the recording paper 116 by ejecting the different color inks from the printing heads 112K, 112C, 112M, and 112Y, respectively, onto the recording paper 116 while conveying the recording paper 116 by the belt conveyance unit 122.

By adopting the recording head 112 in which the full line type heads 112K, 112C, 112M, and 112Y having nozzle rows covering the full paper width are provided for the respective ink colors in this way, it is possible to record an image on the full surface of the recording paper 116 by performing just one operation of relatively moving the recording paper 116 and the recording head 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in a direction (the main scanning direction) orthogonal to the paper conveyance direction.

Although the configuration with the KCMY four standard colors is described in the present embodiment, combinations of the ink colors and the number of colors are not limited to those. Light inks, dark inks or special inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 illustrated in FIG. 11 has an image sensor (line sensor or area sensor) for capturing an image of the ink-droplet deposition result of the recording head 112, and functions as a device to check for ejection properties such as clogs of the nozzles in the recording head 112 and the ink landing position errors from the ink-droplet deposition results evaluated by the image sensor. The print determination unit 124 reads a test chart image or practical image printed by the heads 112K, 112C, 112M, and 112Y for the respective colors, and the ejection of each head is determined. The ejection determination includes measurement of the presence of the ejection, measurement of the dot size, and measurement of the dot deposition position.

A post-drying unit 142 is disposed following the print determination unit 124. The post-drying unit 142 is a device to dry the printed image surface, and includes a heating fan, for example. It is desirable to avoid contact with the printed surface until the printed ink dries, and a device that blows heated air onto the printed surface is desirable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are desirably outputted separately. In the inkjet recording apparatus 110, a sorting device (not illustrated) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not illustrated in FIG. 11, the paper output unit 126A for the target prints is provided with a sorter for collecting prints according to print orders.

Structure of the Head

Next, the structure of heads 112K, 112C, 112M and 112Y will be described. The heads 112K, 112C, 112M and 112Y of the respective ink colors have the same structure, and a reference numeral—150 is hereinafter designated to any of the heads.

Figure 13A:
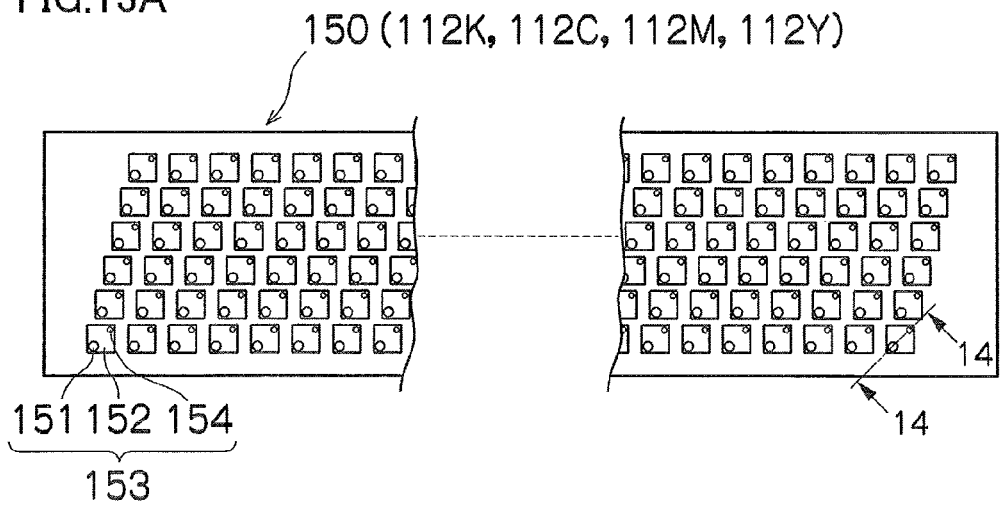
FIG. 13A is a plan view perspective diagram illustrating an example of the structure of a head.
Figure 13B:
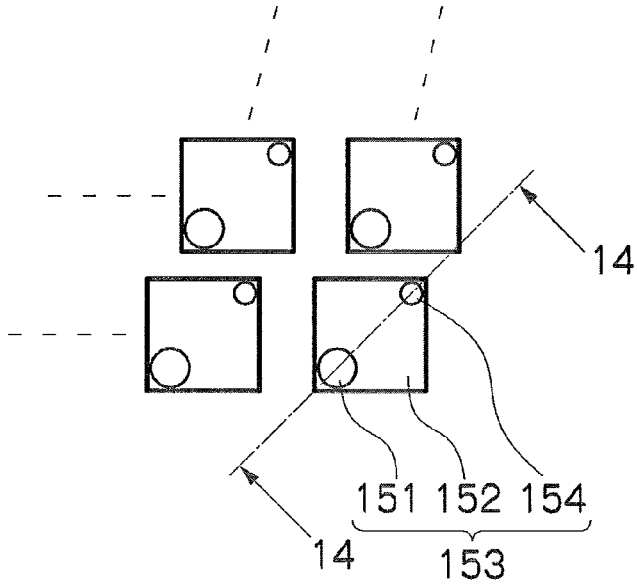
FIG. 13B is a principal part enlarged diagram of FIG. 13A.
Figure 13C:
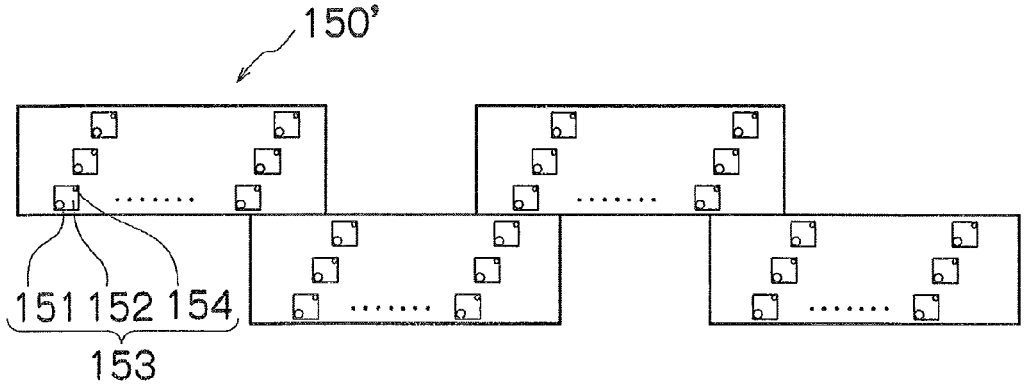
FIG. 13C is a plan view perspective diagram illustrating a further example of the structure of a full-line head.
Figure 14:
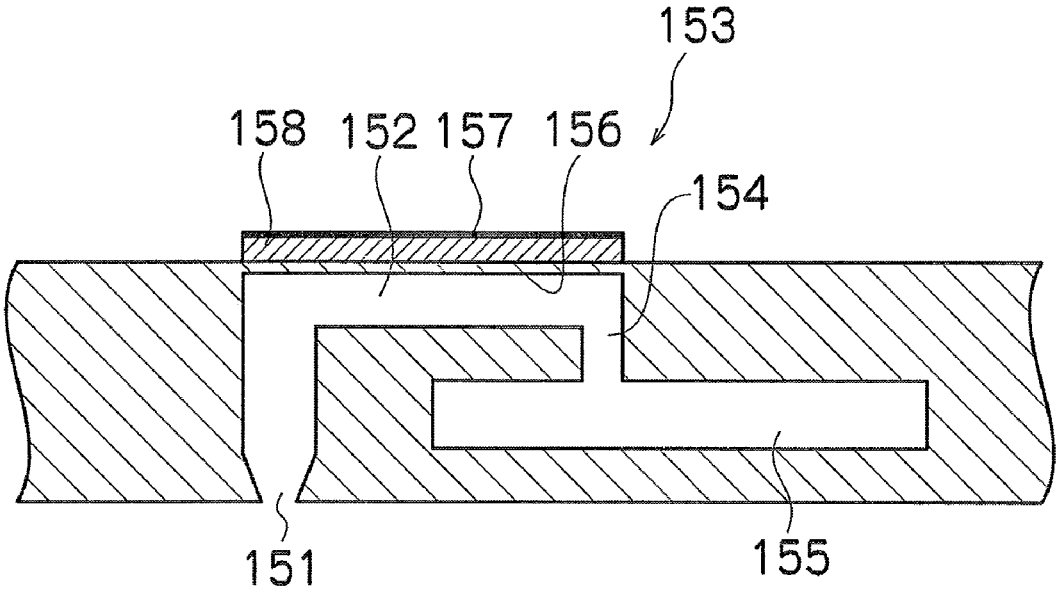
FIG. 14 is a cross-sectional view along line 14-14 in FIGS. 13A and 13B.

FIG. 13A is a plan perspective diagram illustrating an example of the structure of a head 150, and FIG. 13B is a partial enlarged diagram of same. Moreover, FIG. 13C is a plan view perspective diagram illustrating a further example of the structure of the head 150. FIG. 14 is a cross-sectional diagram (a cross-sectional diagram along line 14-14 in FIGS. 13A and 13B) illustrating the composition of one liquid ejection element (an ink chamber unit corresponding to one nozzle 151).

The nozzle pitch in the head 150 should be minimized in order to maximize the density of the dots formed on the surface of the recording paper 116. As illustrated in FIGS. 13A and 13B, the head 150 according to the present embodiment has a structure in which a plurality of ink chamber units (liquid ejection elements) 153, each comprising a nozzle 151 forming an ink droplet ejection hole, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 116 in a direction substantially perpendicular to the paper conveyance direction is not limited to the example described above. For example, instead of the configuration in FIG. 13A, as illustrated in FIG. 13C, a line head having nozzle rows of a length corresponding to the entire width of the recording paper 116 can be formed by arranging and combining, in a staggered matrix, short head modules 150' having a plurality of nozzles 151 arrayed in a two-dimensional fashion.

As illustrated in FIGS. 13A and 13B, the planar shape of a pressure chamber 152 provided corresponding to each nozzle 151 is substantially a square shape, and an outlet port to the nozzle 151 is provided at one of the ends of a diagonal line of the planar shape, while an inlet port (supply port) 154 for supplying ink is provided at the other end thereof. The shape of the pressure chamber 152 is not limited to that of the present example and various modes are possible in which the planar shape is a quadrilateral shape (diamond shape, rectangular shape, or the like), a pentagonal shape, a hexagonal shape, or other polygonal shapes, or a circular shape, elliptical shape, or the like.

As illustrated in FIG. 14, each pressure chamber 152 is connected to a common flow channel 155 via a supply port 154. The common flow channel 155 is connected to an ink tank (not illustrated), which is a base tank that supplies ink, and the ink supplied from the ink tank is delivered through the common flow channel 155 to the pressure chambers 152.

An actuator 158 provided with an individual electrode 157 is bonded to a pressure plate (a diaphragm that also serves as a common electrode) 156 which forms the surface of one portion (in FIG. 14, the ceiling) of the pressure chambers 152. When a drive voltage is applied to the individual electrode 157 and the common electrode, the actuator 158 deforms, thereby changing the volume of the pressure chamber 152. This causes a pressure change which results in ink being ejected from the nozzle 151. For the actuators 158, it is possible to suitably adopt a piezoelectric element using a piezoelectric body, such as lead zirconate titanate, barium titanate, or the like. When the displacement of the actuator 158 returns to its original position after ejecting ink, the pressure chamber 152 is replenished with new ink from the common flow channel 155, via the supply port 154.

Figure 15:
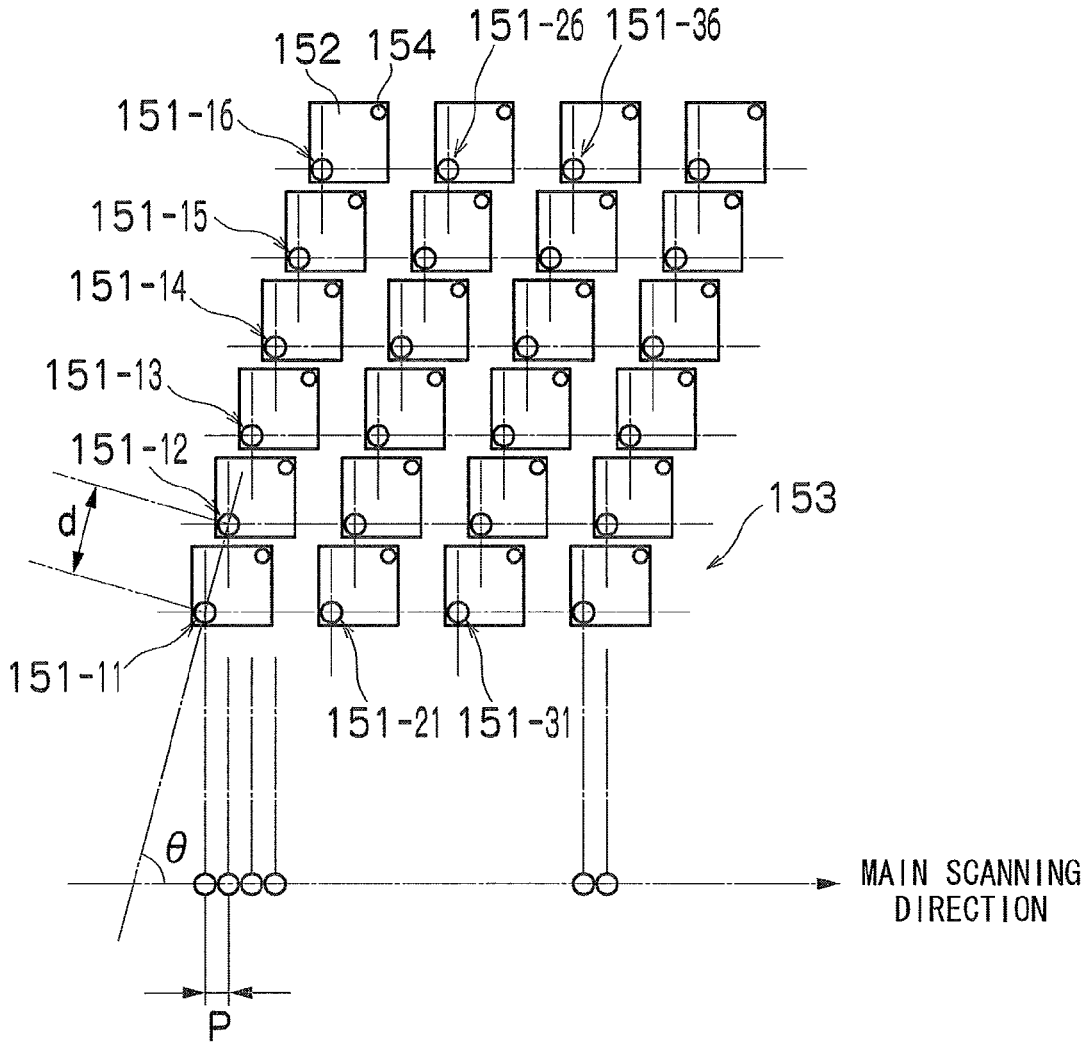
FIG. 15 is an enlarged view illustrating a nozzle arrangement in the printing head illustrated in FIG. 13A.

As illustrated in FIG. 15, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 153 are arranged at a uniform pitch d in line with a direction forming an angle of θ with respect to the main scanning direction, the pitch P of the nozzles projected so as to align in the main scanning direction is $d \times \cos\theta$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch in one nozzle row.

More specifically, in a full-line head comprising rows of nozzles of a length corresponding to the entire width of the printable area, "main scanning" is defined as printing one line (a line formed of a row of dots, or a line formed of a plurality of rows of dots) in the breadthways direction of the paper (the direction perpendicular to the conveyance direction of the paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 151 arranged in a matrix such as that illustrated in FIG. 15 are driven, it is desirable that main scanning is performed in accordance with (3) described above. In other words, one line is printed in the breadthways direction of the recording paper 116 by taking the nozzles 151-11, 151-12, 151-13, 151-14, 151-15, 151-16 as one block (and taking the nozzles 151-21, . . . , 151-26, as one block, the nozzles 151-31, . . . , 151-36 as one block, and so on) and sequentially driving the nozzles 151-11, 151-12, . . . , 151-16 in accordance with the conveyance speed of the recording paper 116.

On the other hand, "sub-scanning" is defined as the action of repeatedly perform printing of one line (a line formed of a row of dots, or a line formed of a plurality of rows of dots) formed by the main scanning action, while moving the full-line head and the paper relatively to each other.

The direction indicated by one line (or the lengthwise direction of a band-shaped region) recorded by the main scanning as described above is called the "main scanning direction", and the direction in which the sub-scanning is performed, is called the "sub-scanning direction". In other words, in the present embodiment, the conveyance direction of the recording paper 116 is called the sub-scanning direction and the direction perpendicular to same is called the main scanning direction.

In implementing the present embodiment, the arrangement of the nozzles is not limited to that of the example illustrated. Moreover, in the present embodiment, a method is employed wherein an ink droplet is ejected by means of the deformation of an actuator 158, which is, typically, a piezoelectric element, but in implementing the present embodiment, there are no particular restrictions on the method used for ejecting ink, and instead of a piezo jet method, it is also possible to apply various other types of methods, such as a thermal jet method, wherein the ink is heated and bubbles are caused to form therein, by means of a heat generating body, such as a heater, ink droplets being ejected by means of the pressure of these bubbles.

Configuration of Control System

Figure 16:
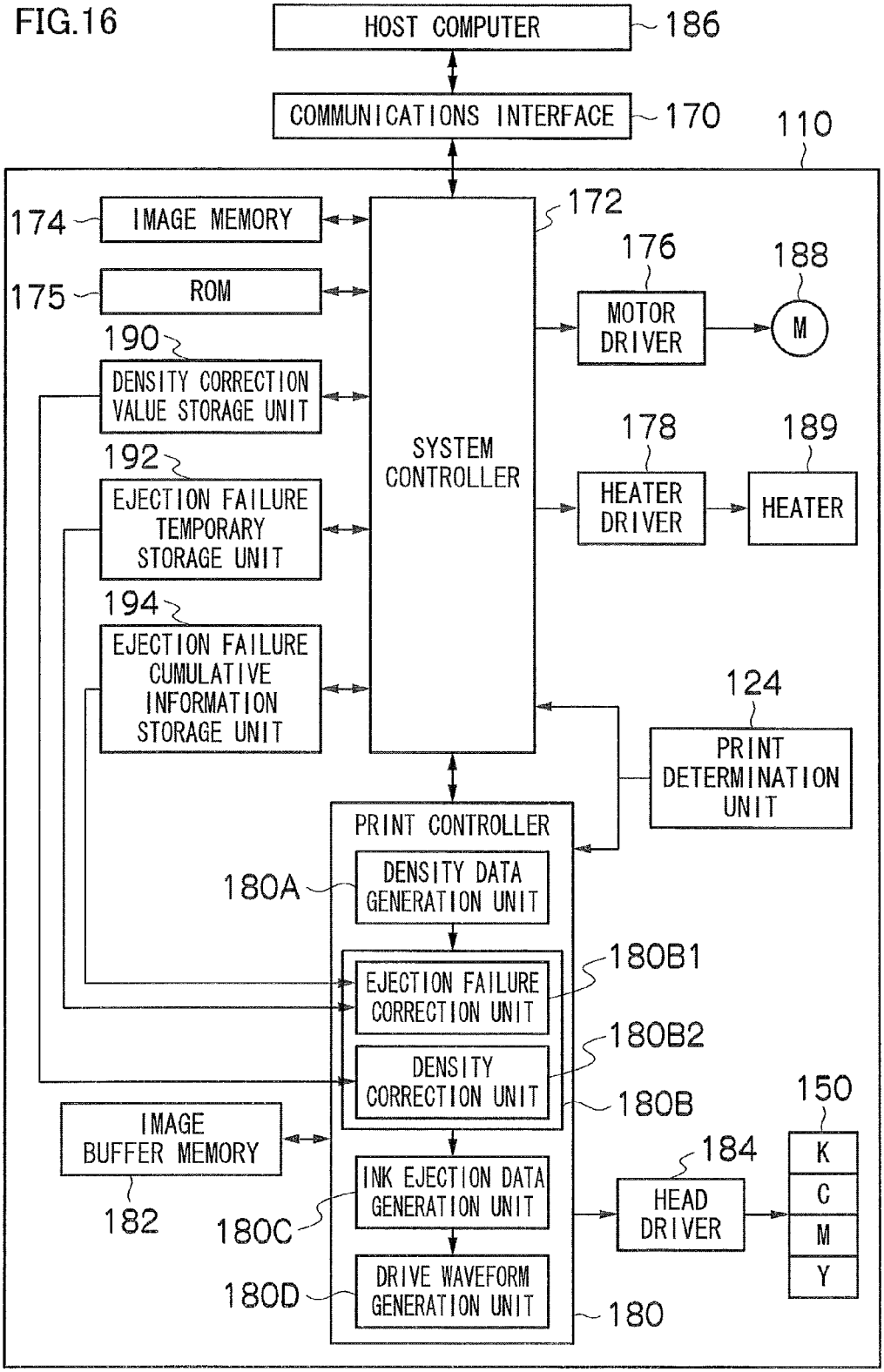
FIG. 16 is a principal block diagram illustrating the system composition of an inkjet recording device.

FIG. 16 is a block diagram illustrating the control system of the inkjet recording device 110.

As illustrated in FIG. 16, the inkjet recording device 110 comprises a communications interface 170, a system controller 172, an image memory 174, a ROM 175, a motor driver 176, a heater driver 178, a print controller 180, an image buffer memory 182, a head driver 184, and the like.

The communications interface 170 is an interface unit (image input device) for receiving image data sent from a host computer 186. A serial interface such as USB (Universal Serial Bus), IEEE1394, Ethernet (registered trademark), wireless network, or a parallel interface such as a Centronics interface may be used as the communications interface 170. A buffer memory (not illustrated) may be mounted in this portion in order to increase the communication speed.

The image data sent from the host computer 186 is received by the inkjet recording device 110 through the communications interface 170, and is temporarily stored in the image memory 174. The image memory 174 is a storage device for storing images inputted through the communications interface 170, and data is written and read to and from the memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and functions as a control device which controls the whole of the inkjet recording device 110 in accordance with prescribed programs, as well as functioning as a calculation device which carries out various calculations. In other words, the system controller 172 controls the various units, such as the communications interface 170, the image memory 174, the motor driver 176, the heater driver 178, and the like, and controls communications with the host computer 186 as well as controlling the reading and writing of data to the image memory 174 and the ROM 175, and furthermore, it also generates control signals for controlling the motor 188 of the conveyance system and the heater 189.

Furthermore, the inkjet recording device 110 also comprises, as information relating to ejection failure nozzles (non-ejection nozzles), the ejection failure temporary information and ejection failure cumulative information, in order to clarify the ejection failure state when outputting a test chart for density measurement. This ejection failure temporary information corresponds to the ejection failure position information (D20) described above and the ejection failure cumulative information corresponds to the ejection failure cumulative information (D22) described above. This information is stored in an ejection failure temporary storage unit 192 and an ejection failure cumulative information storage unit 194.

The system controller 172 extracts ejection failure temporary information indicating an ejection failure nozzle, from read data of a test chart for ejection failure determination read in by the print determination unit 124, and stores this ejection failure temporary information in the ejection failure temporary information storage unit 192. The ejection failure temporary information is accumulated in the ejection failure cumulative information storage unit 194 as ejection failure cumulative information, each time ejection failure determination is carried out.

Moreover, the system controller 172 measures the density measurement value of each nozzle from the read data of the test chart for density measurement read in by the print determination unit 124. This density measurement value corresponds to the density measurement value (D28) described above. Furthermore, a density correction value for each nozzle is calculated from the density measurement values thus measured. This density correction value corresponds to the density correction value (D26) described above. The density correction value thus calculated is stored in a density correction value storage unit 190.

The ROM 175 stores a program which is executed by the CPU of the system controller 172 and various data required for control purposes (including data relating to a test chart for ejection failure determination and a test chart for density measurement), and the like. The ROM 175 may be a non-rewriteable storage device, or a rewriteable storage device, such as an EEPROM. Furthermore, a composition is also possible in which, by using a storage region of the ROM 175, the ROM 175 can also serve as the density correction value storage unit 190, the ejection failure temporary information storage unit 192 and the ejection failure cumulative information storage unit 194.

The image memory 174 is used as a temporary storage region for the image data, and it is also used as a program development region and a calculation work region for the CPU.

The motor driver (drive circuit) 176 drives the motors 188 of the conveyance system in accordance with commands from the system controller 172. The heater driver 178 drives the heaters 189 of the post-drying unit 142 and the like in accordance with commands from the system controller 172.

The print controller 180 is a control unit which functions as a signal processing device for performing various treatment processes, corrections, and the like, in accordance with the control implemented by the system controller 172, in order to generate a signal for controlling droplet ejection from the image data (multiple-value input image data) in the image memory 174, as well as functioning as a drive control device which controls the ejection driving of the head 150 by supplying the ink ejection data thus generated to the head driver 184.

In other words, the print controller 180 comprises a density data generation unit 180A, a correction processing unit 180B, an ink ejection data generation unit 180C and a drive waveform generation unit 180D. These functional blocks (180A to 180D) can be realized by means of an ASIC, software or a suitable combination of same.

The density data generation unit 180A is a signal processing device which generates initial density data for the respective ink colors, from the input image data, and it carries out density conversion processing (including UCR processing and color conversion) and, where necessary, also performs pixel number conversion processing.

The correction processing unit 180B is a processing device which carries out non-uniformity correction processing, and is constituted by an ejection failure correction unit 180B1 and a density correction unit 180B2. The ejection failure correction unit 180B1 is a processing device which carries out calculation for ejection failure correction using ejection failure temporary information stored in the ejection failure temporary information storage unit 192 and ejection failure cumulative information stored in the ejection failure cumulative information storage unit 194, and this processing corresponds to the ejection failure correction (D12) described above. Furthermore, the density correction unit 180B2 is a processing device which carries out calculation for density correction using the density correction values stored in the density correction storage unit 190, and this processing corresponds to the density correction (D14) described above.

The ink ejection data generation unit 180C is a signal processing device which includes a half-toning processing device for converting the corrected density data generated by the correction processing unit 180B into binary (or multiple-value) dot data, and performs binary (multiple-value) conversion processing. The ink ejection data generated by the ink ejection data generation unit 180C is supplied to the head driver 184, which controls the ink ejection operation of the head 150 accordingly.

The drive waveform generation unit 180D is a device for generating drive signal waveforms in order to drive the actuators 158 (see FIG. 14) corresponding to the respective nozzles 151 of the head 150. A signal (drive waveform) generated by the drive waveform generation unit 180D is supplied to the head driver 184. The signal output from the drive waveform generation unit 180D may be digital waveform data, or it may be an analog voltage signal.

The image buffer memory 182 is provided in the print controller 180, and image data, parameters, and other data are temporarily stored in the image buffer memory 182 when image data is processed in the print controller 180. FIG. 16 illustrates a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed is input from an external source via the communications interface 170, and is accumulated in the image memory 174. At this stage, multiple-value RGB image data is stored in the image memory 174, for example.

In this inkjet recording device 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, the original image data (RGB data) stored in the image memory 174 is sent to the print controller 180, via the system controller 172, and is converted to the dot data for each ink color by passing through the density data generation unit 180A, the correction processing unit 180B, and the ink ejection data generation unit 180C of the print controller 180.

In other words, the print controller 180 performs processing for converting the input RGB image data into dot data for the four colors of K, C, M and Y. The dot data generated by the print controller 180 in this way is stored in the image buffer memory 182. This dot data of the respective colors is converted into CMYK droplet ejection data for ejecting ink from the nozzles of the head 150, thereby establishing the ink ejection data to be printed.

The head driver 184 outputs a drive signal for driving the actuators 158 corresponding to the nozzles 151 of the head 150 in accordance with the print contents, on the basis of the ink ejection data and the drive waveform signals supplied by the print controller 180. A feedback control system for maintaining constant drive conditions in the head may be included in the head driver 184.

By supplying the drive signal output by the head driver 184 to the head 150 in this way, ink is ejected from the corresponding nozzles 151. By controlling ink ejection from the printing head 150 in synchronization with the conveyance speed of the recording paper 116, an image is formed on the recording paper 116.

As described above, the ejection volume and the ejection timing of the ink droplets from the respective nozzles are controlled via the head driver 184, on the basis of the ink ejection data and the drive signal waveform generated by implementing prescribed signal processing in the print controller 180. By this means, desired dot size and dot positions can be achieved.

As illustrated in FIG. 11, the print determination unit 124 is a block including an image sensor which reads in the image printed onto the recording medium 116, performs required signal processing operations, and the like, and determines the print situation (presence/absence of ejection, variation in droplet ejection, optical density, and the like), these determination results being supplied to the print controller 180 and the system controller 172.

The print controller 180 implements various corrections with respect to the head 150, on the basis of the information obtained from the print determination unit 124, according to requirements, and it implements control for carrying out cleaning operations (nozzle restoring operations), such as preliminary ejection, suctioning, or wiping, as and when necessary.

It is also possible to adopt a mode in which all or a portion of the functions carried out by the density data generation unit 180A, and the correction processing unit 180B illustrated in FIG. 16 are installed in the host computer 186 side.

Acquiring Ejection Failure Temporary Information

The inkjet recording device 110 is able to acquire ejection failure temporary information relating to an ejection failure nozzle of the nozzles of the recording head 112, by outputting a test chart for ejection failure determination to media and reading in an image of the test chart for ejection failure determination by means of the print determination unit 124.

Figure 17:
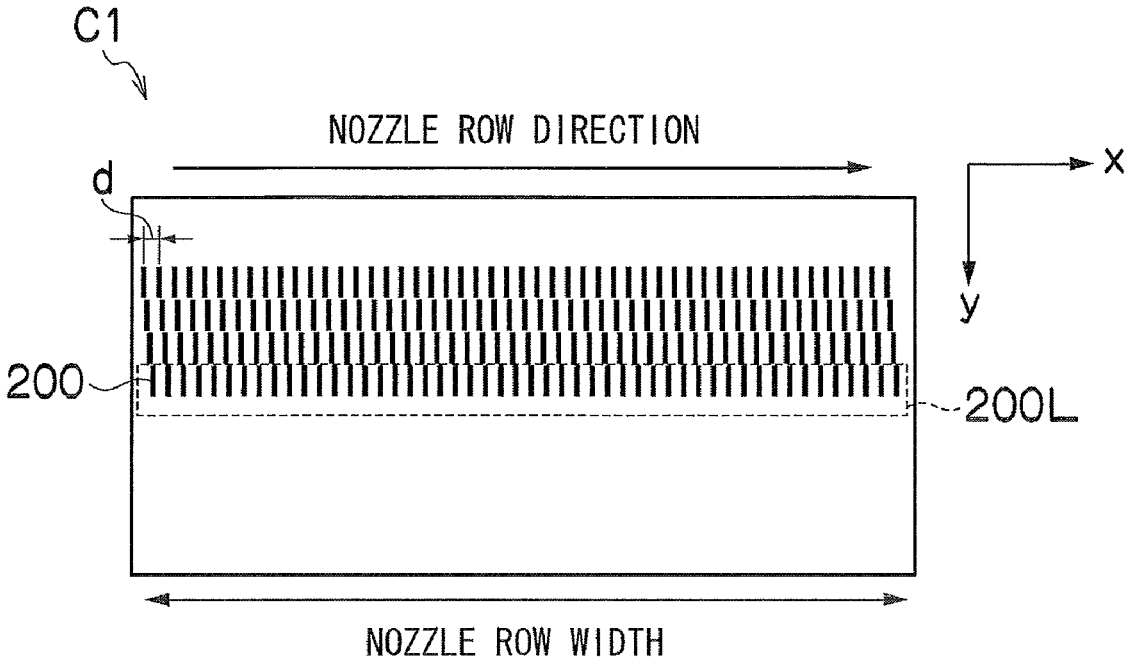
FIG. 17 is a plan diagram illustrating an example of a test chart for ejection failure determination.

FIG. 17 is a plan diagram illustrating an example of a test chart for ejection failure determination, and here a test chart for ejection failure determination printed by a head of one color, of the heads of respective colors, is depicted.

As illustrated in FIG. 17, the test chart for ejection failure determination C1 is formed by printing, at prescribed intervals in the x direction, line-shaped patterns 200 which are substantially parallel to the y direction, by using the recording head 112. Here, the distance d in the x direction between the patterns 200 is set in accordance with the resolution of the print determination unit 124. For instance, if the nozzle density N in the x direction of the recording head 112 is 1200 npi and the reading resolution R in the x direction of the print determination unit 124 is 400 dpi, then the distance d in the x direction between the patterns 200 satisfies $d \geqq 1/R = 1/400$ (inch).

When creating a test chart for ejection failure determination C1, more specifically, a pattern 200L corresponding to one line is printed by ejecting liquid every other n nozzles ($n \geqq 3 (= N/R = 1200/400)$) in the x direction. Thereupon, the nozzles which eject liquid are shifted by one nozzle in the x direction and printing is carried out from every other n nozzles. By repeating this n times, the pattern 200 is printed by ejecting liquid from all of the nozzles. By this means, it is possible to create a test chart for ejection failure determination C1 from which it can be judged whether or not each of the nozzles is an ejection failure nozzle, at the resolution of the print determination unit 124.

Information about ejection failure nozzles identified by reading in an image of the test chart for ejection failure determination by means of the print determination unit 124 is stored in the ejection failure temporary information storage unit 192, as ejection failure temporary information. As stated above, since the ejection failure temporary information is added to the ejection failure cumulative information each time ejection failure determination is carried out (each time the test chart for ejection failure determination is read in), then it is possible to identify a newly occurring ejection failure nozzle from the difference between the newly acquired ejection failure temporary information and the ejection failure cumulative information stored in the ejection failure cumulative information storage unit 194.

Acquiring Density Measurement Values

The inkjet recording device 110 acquires a density correction value for each color at a timing instructed by the user, for instance, when the power supply is switched on. The density correction values are acquired by reading in a test chart for density measurement which has been output.

Figure 18:
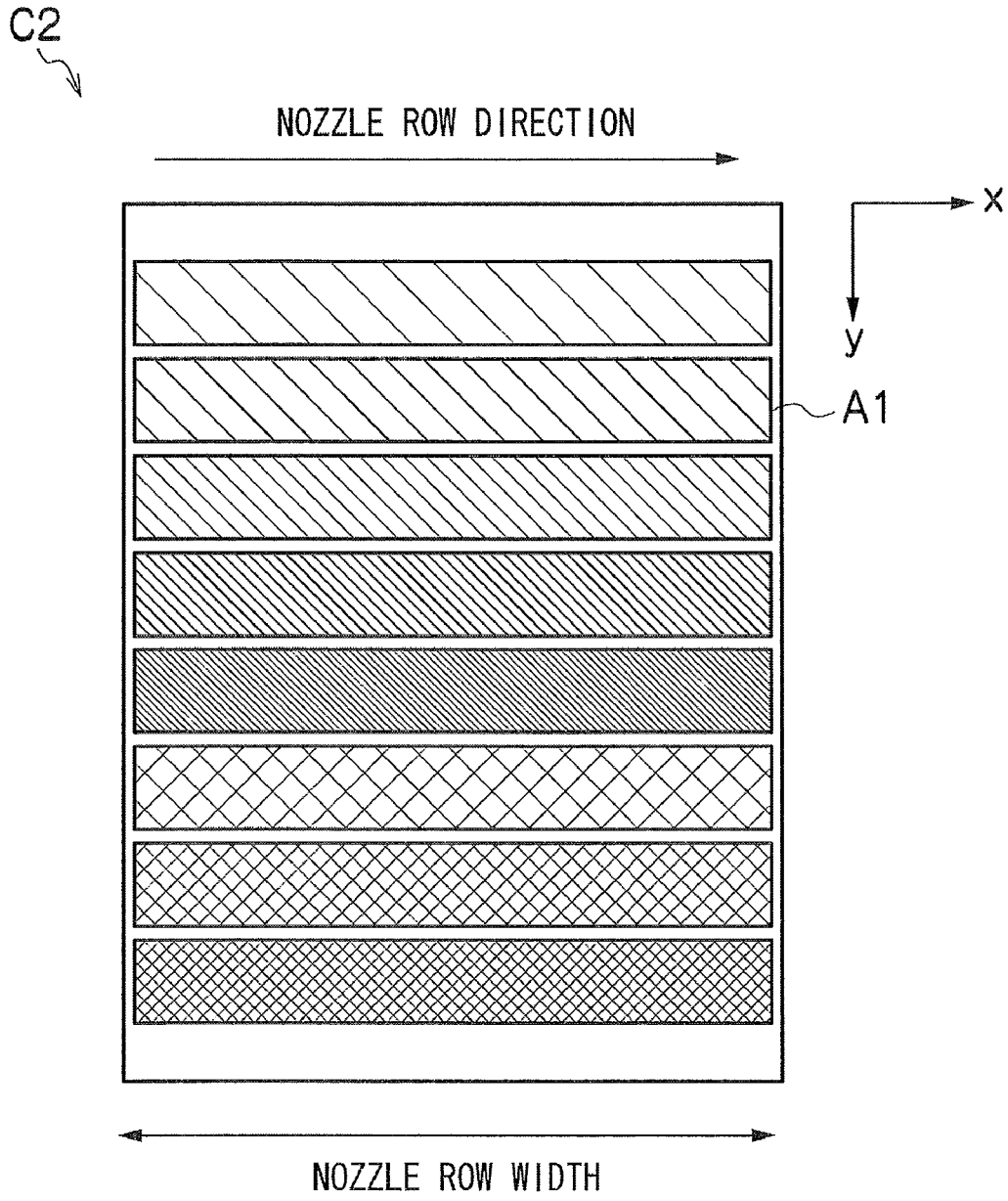
FIG. 18 is a plan diagram illustrating a test chart for density measurement.

FIG. 18 is a plan diagram illustrating a test chart for density measurement, and here a test chart for density measurement printed by a head of one color, of the heads of respective colors, is depicted. As illustrated in FIG. 18, the test chart for density measurement C2 is created by printing density patches of a plurality of levels (in FIG. 18, 8 levels) in the y direction, while maintaining uniform density in the x direction. The image data set in step S10 in FIG. 4 includes test charts for density measurement for the respective colors of C, M, Y and K.

The image of the test chart for density measurement is read in by the print determination unit 124, the processing described in FIG. 6 is carried out by the system controller 172, and density measurement values are acquired.

Image Output Processing

Figure 19:
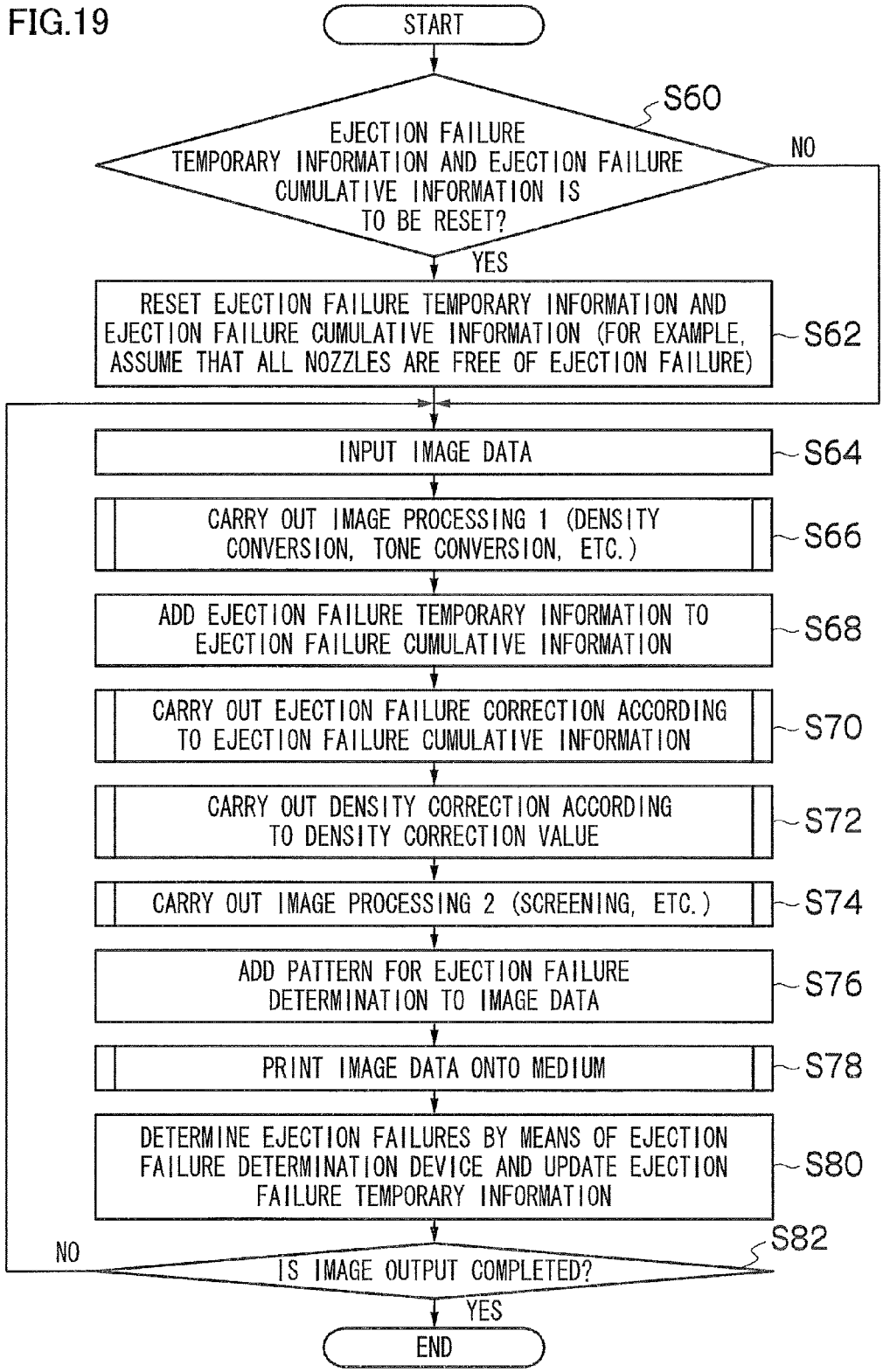
FIG. 19 is a flowchart showing an image output operation of the inkjet recording device.

FIG. 19 is a flowchart showing an image output operation of the inkjet recording device 110.

Firstly, it is judged whether or not to reset the ejection failure temporary information and the ejection failure cumulative information (step S60). These sets of information can be reset by the user either after maintenance or after installation, and if reset is selected, the ejection failure temporary information and the ejection failure cumulative information are reset (step S62). When the information is reset, all of the nozzles are treated as being normal and free of ejection failures, for example. It is also possible to adopt a composition in which the settings made upon shipment from the factory are used when the information is reset. For example, it is possible to adopt a composition in which the positions of ejection failure nozzles determined in inspection upon shipment from the factory are stored in the ejection failure cumulative information storage unit 194 and this information may not be erased even when reset. By adopting a composition of this kind, ejection failure nozzles determined upon shipment are treated as ejection failure nozzles, even when the information is reset.

If the ejection failure temporary information and the ejection failure cumulative information is reset at step S62, or if it is judged at step S60 that reset is not necessary, then the procedure advances to step S64, and image data for outputting to media is input via the communications interface 170.

The system controller 172 carries out image processing 1 in respect of the input image data (step S66). This image processing 1 is image processing, such as density conversion or tone conversion.

Next, the ejection failure temporary information is added to the ejection failure cumulative information (step S68). Moreover, ejection failure correction is carried out on the basis of the ejection failure cumulative information (step S70). As stated above, the ejection failure correction involves carrying out processing for changing the image data and processing for making the ink droplet ejection size larger in such a manner that substitute droplet ejection (increase in number of droplet ejections) is performed from adjacent nozzles to the nozzle suffering an ejection failure. Moreover, it is also possible to halt the driving of a piezoelectric actuator corresponding to an ejection failure nozzle, and thereby avoid wasted power consumption.

The input image data which has been subjected to ejection failure correction is input to the print controller 180, and initial density data for each ink color is generated in the density data generation unit 180A. The correction processing unit 180B reads in pixel value differentials which have been stored as density correction values, from the density correction value storage unit 190, and performs density correction of the respective nozzles on the basis of the pixel value differentials. (step S72).

Furthermore, the ink ejection data generation unit 180C carries out halftone processing in respect of the corrected density data generated by the correction processing unit 180B and thereby produces binary (or multiple-value) dot data (step S74).

Here, the test chart for ejection failure determination is added to the image data (step S76). The test chart for ejection failure determination is stored in the ROM 175 and is added to the margin area of the output image, for each color of C, M, Y and K.

The print controller 180 prints the input image data and the image data of a test chart for ejection failure determination added at step S46, onto media (step S78).

The system controller 172 extracts information relating to the ejection failure nozzles of respective colors, from the read data of the test chart for ejection failure determination which has been read in by the print determination unit 124, and updates the ejection failure temporary information stored in the ejection failure temporary information storage unit 192 (step S80).

Finally, it is judged whether or not image output has been completed (step S82), and if image output is to be continued, then the procedure returns to step S64 and similar processing is continued. For each ejection failure nozzle which is newly determined at step S80, ejection failure temporary information is added to the ejection failure cumulative information at step S68, and ejection failure correction is carried out on the basis of the ejection failure cumulative information at step S70. Therefore, ejection failure correction is carried out properly in respect of the subsequently output images.

In the present embodiment, a print determination unit (scanner) 124 is provided in the inkjet recording device 110, but it is also possible to provide a print determination unit for reading a test chart for density measurement, separately from the inkjet recording device 110.

Furthermore, the processing of the input density data may be carried out by an image processing apparatus which is separate from the inkjet recording device 110.

Furthermore, in the embodiment described above, the present invention is applied to an inkjet recording device, but the scope of application of the present invention is not limited to this. More specifically, the present invention can also be applied to image recording apparatuses using formats other than an inkjet recording device, for example, a thermal transfer recording device comprising a recording head which uses thermal elements as recording elements, an LED electrophotographic printer comprising a recording head which uses LED elements as recording elements, or a silver photographic printer (silver halide photography printer) which has an LED line exposure head.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a recording head having a plurality of recording elements;

a conveyance device which conveys at least one of the recording head and a recording medium so as to cause relative movement between the recording head and the recording medium;

a recording defect information acquisition device which acquires recording defect information indicating a recording element having a recording defect, of the plurality of recording elements;

a recording defect correction device which corrects an image defect caused by the recording element having a recording defect, according to the recording defect information acquired by the recording defect information acquisition device;

an image reading apparatus which reads in an image of a test chart for density measurement recorded by the recording head, the image of the test chart for density measurement having been corrected by the recording defect correction device;

a recording density information acquisition device which acquires recording density information indicating recording density of the plurality of recording elements, according to the image of the test chart for density measurement read in by the image reading apparatus;

a density correction information calculation device which calculates density correction information according to the recording density information acquired by the recording density information acquisition device;

a density correction device which corrects density of image data according to the density correction information calculated by the density correction information calculation device;

an uncorrected recording defect information acquisition device which acquires uncorrected recording defect information indicating a recording element having a new recording defect which has not been corrected by the recording defect correction device when the test chart for density measurement is output; and a recording density information amendment device which amends the density correction information according to the uncorrected recording defect information acquired by the uncorrected recording defect information acquisition device.

2. The image recording apparatus as defined in claim 1, wherein:

the plurality of recording elements of the recording head are arranged through a length corresponding to entire recordable width of the recording medium; and the conveyance device conveys at least one of the recording head and a recording medium so as to cause just one relative movement between the recording head and the recording medium.

3. The image recording apparatus as defined in claim 1, wherein the uncorrected recording defect information acquisition device acquires the uncorrected recording defect information according to a difference between the known recording defect information and the latest recording defect information.

4. The image recording apparatus as defined in claim 1, wherein the recording density information amendment device amends the density correction information according to the recording density information of a recording element separated by a prescribed amount in a recordable width direction of the recording medium from the recording element having the new recording defect.

5. The image recording apparatus as defined in claim 4, wherein the prescribed amount is specified in such a manner that there is no other recording element having a new recording defect between the recording element having the new recording defect and the recording element separated by the prescribed amount.

6. The image recording apparatus as defined in claim 1, wherein:

the test chart for density measurement is constituted by a plurality of different density patterns;

the density correction device acquires the recording density information for each of the plurality of different density patterns; and the recording density information amendment device amends the density correction information for each of the plurality of different density patterns.

7. The image recording apparatus as defined in claim 1, wherein:

the plurality of recording elements are ink ejection nozzles; and the recording defect information is information indicating an ink ejection nozzle having an ejection defect.

8. The image recording apparatus as defined in claim 7, wherein the recording defect information acquisition device and the uncorrected recording defect information acquisition device acquire information indicating the ink ejection nozzle having the ejection defect by reading in, with the image reading device, an image of a test chart for ejection defect determination recorded by the recording head.

9. The image recording apparatus as defined in claim 7, wherein the recording defect correction device corrects the image defect due to the ink ejection nozzle having the ejection defect by performing substitute droplet ejection from a nozzle adjacent to the ink ejection nozzle having the ejection defect, or by increasing an ejection size of an ink droplet from a nozzle adjacent to the ink ejection nozzle having the ejection defect.

10. The image recording apparatus as defined in claim 1, wherein a plurality of the recording heads are provided respectively for a plurality of colors.

11. The image recording apparatus as defined in claim 1, wherein a reading resolution of the image reading device with respect to a direction following arrangement of the plurality of recording elements is smaller than a recording resolution of the plurality of recording elements.

12. The image recording apparatus as defined in claim 1, wherein the density correction information calculation device calculates the density correction information according to the recording density information in such a manner that the recording density of the plurality of recording elements is uniform.

13. An image processing apparatus, comprising:

a recording defect information acquisition device which acquires recording defect information indicating a recording element having a recording defect, of a plurality of recording elements of a recording head;

a recording defect correction device which corrects an image defect caused by the recording element having the recording defect, according to the recording defect information acquired by the recording defect information acquisition device;

a recording density information acquisition device which acquires recording density information indicating recording density of the plurality of recording elements, according to an image of a test chart for density measurement read by an image reading device, the test chart for density measurement having been corrected by the recording defect correction device and having been recorded by the recording head;

a density correction information calculation device which calculates density correction information according to the recording density information acquired by the recording density information acquisition device;

a density correction device which corrects density of image data according to the density correction information calculated by the density correction information calculation device;

an uncorrected recording defect information acquisition device which acquires uncorrected recording defect information indicating a recording element having a new recording defect which has not been corrected by the recording defect correction device when the test chart for density measurement is output; and a recording density information amendment device which amends the density correction information according to the uncorrected recording defect information acquired by the uncorrected recording defect information acquisition device.

14. An image processing method, comprising:

a recording defect information acquisition step of acquiring recording defect information indicating a recording element having a recording defect, of a plurality of recording elements of a recording head;

a recording defect correction step of correcting an image defect caused by the recording element having the recording defect, according to the recording defect information acquired in the recording defect information acquisition step;

a recording density information acquisition step of acquiring recording density information indicating recording density of the plurality of recording elements, according to an image of a test chart for density measurement read by an image reading device, the test chart for density measurement having been corrected in the recording defect correction step and having been recorded by the recording head;

a density correction information calculation step of calculating density correction information according to the recording density information acquired in the recording density information acquisition step;

a density correction step of correcting density of image data according to the density correction information calculated in the density correction information calculation step;

an uncorrected recording defect information acquisition step of acquiring uncorrected recording defect information indicating a recording element having a new recording defect which has not been corrected in the recording defect correction step when the test chart for density measurement is output; and a recording density information amendment step of amending the density correction information according to the uncorrected recording defect information acquired in the uncorrected recording defect information acquisition step.

15. A computer-readable medium storing instructions to cause a computer to execute at least an image processing method comprising:

a recording defect information acquisition step of acquiring recording defect information indicating a recording element having a recording defect, of a plurality of recording elements of a recording head;

a recording defect correction step of correcting an image defect caused by the recording element having the recording defect, according to the recording defect information acquired in the recording defect information acquisition step;

a recording density information acquisition step of acquiring recording density information indicating recording density of the plurality of recording elements, according to an image of a test chart for density measurement read by an image reading device, the test chart for density measurement having been corrected in the recording defect correction step and having been recorded by the recording head;

a density correction information calculation step of calculating density correction information according to the recording density information acquired in the recording density information acquisition step;

a density correction step of correcting density of image data according to the density correction information calculated in the density correction information calculation step;

an uncorrected recording defect information acquisition step of acquiring uncorrected recording defect information indicating a recording element having a new recording defect which has not been corrected in the recording defect correction step when the test chart for density measurement is output; and a recording density information amendment step of amending the density correction information according to the uncorrected recording defect information acquired in the uncorrected recording defect information acquisition step.

* * * * *